US008061060B2

(12) United States Patent
Swigart et al.

(10) Patent No.: US 8,061,060 B2
(45) **Date of Patent: *Nov. 22, 2011**

(54) ARTICLE OF FOOTWEAR OR OTHER FOOT-RECEIVING DEVICE HAVING A FOAM OR FLUID-FILLED BLADDER ELEMENT WITH SUPPORT AND REINFORCING STRUCTURES

(75) Inventors: John F. Swigart, Portland, OR (US); Eric S. Schindler, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/701,903

(22) Filed: Feb. 8, 2010

(65) Prior Publication Data

US 2010/0132221 A1 Jun. 3, 2010

Related U.S. Application Data

(63) Continuation of application No. 11/422,139, filed on Jun. 5, 2006, now Pat. No. 7,685,743.

(51) Int. Cl.
*A43B 13/18* (2006.01)

(52) U.S. Cl. ..... 36/28; 36/29; 36/37; 36/35 R

(58) Field of Classification Search ..... 36/28, 29, 36/35 R, 35 B, 37, 59 R, 59 C, 59 A
See application file for complete search history.

(56) References Cited

U.S. PATENT DOCUMENTS 4,183,156 A 1/1980 Rudy
4,219,945 A 9/1980 Rudy
4,535,553 A 8/1985 Derderian et al.
4,936,029 A 6/1990 Rudy
5,042,176 A 8/1991 Rudy
5,172,494 A * 12/1992 Davidson ..... 36/35 R
5,224,278 A 7/1993 Jeon
5,311,674 A 5/1994 Santiyanont et al.
5,572,804 A 11/1996 Skaja et al.

(Continued)

FOREIGN PATENT DOCUMENTS

EP 1447020 8/2004

(Continued)

OTHER PUBLICATIONS

International Search Report in corresponding PCT Application, International Application No. PCT/US2007/012666, mailed Oct. 2, 2007.

(Continued)

*Primary Examiner* — Marie Patterson
(74) *Attorney, Agent, or Firm* — Banner & Witcoff, Ltd.

(57) ABSTRACT

Impact-attenuating elements, e.g., for use in footwear or other foot-receiving device products, may include: (a) a base member, such as a fluid-tight and/or other fluid-filled or fluid-containing enclosure element; (b) a support element integrally and contiguously formed in a surface of the base member; and/or (c) a spring device engaged with the support element. The support element and its corresponding spring device (if any) may include a non-planar surface (e.g., substantially parabolic shaped, cylindrically shaped, etc.) that extends in a direction into the base member and toward its opposite surface. The support element and its corresponding spring device (if any) also may include reinforcing structure(s), such as raised ribs extending along a surface of the support element and/or spring device.

28 Claims, 15 Drawing Sheets

U.S. PATENT DOCUMENTS

| | | | | |
|---|---|---|---|---|
| 5,718,063 | A * | 2/1998 | Yamashita et al. | 36/28 |
| 5,918,384 | A * | 7/1999 | Meschan | 36/37 |
| 5,940,989 | A | 8/1999 | Liou | |
| 5,952,065 | A | 9/1999 | Mitchell et al. | |
| 5,976,451 | A | 11/1999 | Skaja et al. | |
| 6,013,340 | A | 1/2000 | Bonk et al. | |
| 6,029,962 | A * | 2/2000 | Shorten et al. | 267/145 |
| 6,076,282 | A | 6/2000 | Brue | |
| 6,266,898 | B1 | 7/2001 | Cheng | |
| 6,354,021 | B1 * | 3/2002 | Deacon et al. | 36/127 |
| 6,374,514 | B1 | 4/2002 | Swigart | |
| 6,685,011 | B2 * | 2/2004 | Nishiwaki et al. | 36/28 |
| 6,789,333 | B2 * | 9/2004 | Nishiwaki et al. | 36/28 |
| 6,880,267 | B2 * | 4/2005 | Smaldone et al. | 36/28 |
| 6,883,253 | B2 * | 4/2005 | Smith et al. | 36/28 |
| 6,931,764 | B2 | 8/2005 | Swigart et al. | |
| 6,964,120 | B2 * | 11/2005 | Cartier et al. | 36/29 |
| 6,968,636 | B2 * | 11/2005 | Aveni et al. | 36/28 |
| 7,082,699 | B2 | 8/2006 | Nishiwaki et al. | |
| 7,228,648 | B2 * | 6/2007 | Yang | 36/35 R |
| 7,331,124 | B2 * | 2/2008 | Meschan | 36/35 R |
| 7,360,324 | B2 * | 4/2008 | Aveni | 36/27 |
| 2005/0039347 | A1 * | 2/2005 | Meschan | 36/29 |
| 2005/0132607 | A1 | 6/2005 | Dojan et al. | |
| 2005/0132608 | A1 | 6/2005 | Dojan et al. | |
| 2005/0132610 | A1 | 6/2005 | Foxen et al. | |
| 2005/0133968 | A1 | 6/2005 | Foxen et al. | |
| 2006/0137221 | A1 | 6/2006 | Dojan et al. | |
| 2006/0254087 | A1 | 11/2006 | Fechter | |
| 2008/0184600 | A1 | 8/2008 | Yang | |
| 2008/0244927 | A1 | 10/2008 | Wyszynski et al. | |

FOREIGN PATENT DOCUMENTS

| | | |
|---|---|---|
| WO | 9922160 | 5/1999 |
| WO | 0231377 | 4/2002 |

OTHER PUBLICATIONS

International Preliminary Report on Patentability in corresponding PCT Application, International Application No. PCT/US2007/012666, mailed Dec. 24, 2008.

First Office Action in related Chinese application, Application No. 200780025444.9, issued Feb. 5, 2010.

* cited by examiner

ARTICLE OF FOOTWEAR OR OTHER FOOT-RECEIVING DEVICE HAVING A FOAM OR FLUID-FILLED BLADDER ELEMENT WITH SUPPORT AND REINFORCING STRUCTURES

I. RELATED APPLICATION DATA

This application is a continuation of U.S. patent application. Ser. No. 11/422,139 filed Jun. 5, 2006 in the names of John F. Swigart and Eric Steven Schindler and entitled "Article of Footwear or Other Foot-Receiving Device having a Fluid-Filled Bladder with Support and Reinforcing Structures," now U.S. Pat. No. 7,685,743. This priority application is entirely incorporated herein by reference.

II. BACKGROUND

A. Field of the Invention

The present invention generally relates to footwear and other foot-receiving devices. Aspects of the invention relate more particularly to impact-attenuating elements for articles of footwear or other foot-receiving devices.

B. Description of Background Art

Conventional articles of athletic footwear have included two primary elements, namely, an upper member and a sole structure. The upper member provides at least a partial covering for the foot that securely receives and positions the foot with respect to the sole structure. In addition, the upper member may have structures and a configuration that protect the foot and provide ventilation, thereby keeping the foot cool and removing perspiration. The sole structure generally is secured to a lower portion of the upper member and generally is positioned between the foot and the ground. In addition to attenuating ground reaction forces, the sole structure may provide traction and help control foot motions, such as pronation. Accordingly, the upper member and the sole structure operate cooperatively to provide a comfortable structure that is suited for a variety of ambulatory activities, such as walking and running.

The sole structure of at least some athletic footwear has exhibited a layered configuration that includes a comfort-enhancing insole, a resilient midsole (e.g., formed from a polymer foam material), and a ground-contacting outsole that provides both abrasion-resistance and traction. The midsole typically is the primary sole structure element that attenuates ground reaction forces and controls foot motions. Suitable polymer foam materials for the midsole include ethylvinylacetate or polyurethane that compress resiliently under an applied load to attenuate ground reaction forces.

One manner of reducing the weight of a polymer foam midsole and decreasing the effects of deterioration following repeated compression cycles is disclosed in U.S. Pat. No. 4,183,156 to Rudy, which patent is entirely incorporated herein by reference. In the Rudy construction, a fluid-filled bladder formed of elastomeric materials is provided. The bladder includes a plurality of tubular chambers that extend longitudinally along a length of the sole structure. The chambers are in fluid communication with each other and jointly extend across the width of the footwear. The bladder may be encapsulated in a polymer foam material, as disclosed in U.S. Pat. No. 4,219,945 (also to Rudy), which patent also is entirely incorporated herein by reference. The combination of the bladder and the encapsulating polymer foam material functions as a midsole. Accordingly, an upper member is attached to the upper surface of the polymer foam material and an outsole or tread member is affixed to its lower surface.

Bladders of the type described above are generally formed of elastomeric material and are structured to have upper and lower portions that enclose one or more chambers therebetween. The chambers are pressurized above ambient pressure by inserting a nozzle or needle connected to a fluid pressure source into a fill inlet formed in the bladder. Following pressurization of the chambers, the fill inlet is sealed and the nozzle is removed.

While such gas-filled bladders can be quite comfortable underfoot for the wearer, these bladders can lack the support or variance in support at different areas of the foot necessary for some activities, particularly athletic activities. Accordingly, there is a need in the art for impact-attenuating devices that provide a comfortable footbed while still providing adequate support and vertical deflection capabilities.

III SUMMARY

The following presents a general summary of aspects of the invention in order to provide a basic understanding of at least some aspects of the invention. This summary is not an extensive overview of the invention. It is not intended to identify key or critical elements of the invention or to delineate the scope of the invention. The following summary merely presents some concepts of the invention in a general form as a prelude to the more detailed description that follows.

Aspects of the present invention generally relate to impact-attenuating elements for attenuating ground reaction forces and the like, e.g., for use in footwear or other foot-receiving device products. Example impact-attenuating elements in accordance with aspects of this invention may include: (a) a base member, such as an enclosure element at least partially defining at least one fluid-tight or other fluid-containing chamber; (b) a support element integrally and contiguously formed in a surface of the base member; and/or (c) a spring device engaged with the support element. The support element and its corresponding spring device (if any) may include a non-planar surface (e.g., substantially parabolic shaped, cylindrically shaped, etc.) that extends in a direction into the fluid-containing chamber or other base member and toward its opposite surface. The support element and its corresponding spring device (if any) also may include reinforcing structure(s), e.g., in the form of rib elements extending along or from a surface of the support element and/or spring device. Any number of support elements, spring devices, and/or reinforcing structures may be included in the impact-attenuating element without departing from the invention.

The impact-attenuating element may be appropriately sized, shaped, and constructed so as to fit into and/or constitute a portion of a foot-receiving device structure, such as an article of footwear. The impact-attenuating element may constitute, for example, a heel or midsole portion of the article of footwear or other foot-receiving device product or it may constitute a footbed that supports all or substantially all of the plantar surface of a wearer's foot.

IV. BRIEF DESCRIPTION OF THE DRAWINGS

The foregoing Summary, as well as the following Detailed Description, will be better understood when read in conjunction with the accompanying drawings, in which.

V. DETAILED DESCRIPTION

Figure 1A:
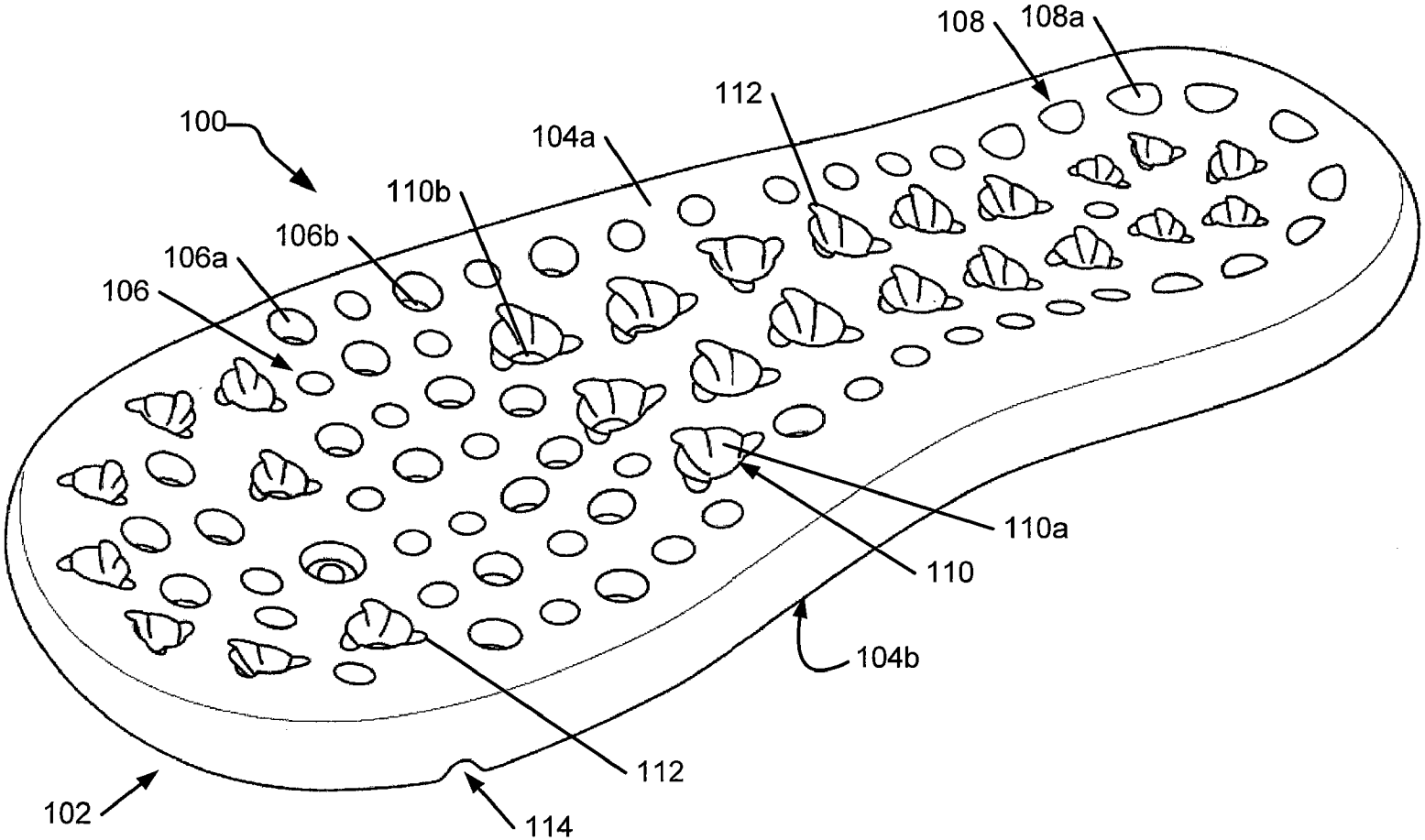
FIGS. 1A through 1F illustrate various views of an example impact-attenuating element in accordance with this invention in the form of a footbed for supporting essentially an entire plantar surface of a wearer's foot.

In the following description of various examples of the invention, reference is made to the accompanying drawings, which form a part hereof, and in which are shown by way of illustration various example structures, systems, and environments in which the invention may be practiced. It is to be understood that other specific arrangements of parts, example structures, systems, and environments may be utilized, and that structural and functional modifications may be made without departing from the scope of the present invention. Also, while the terms "top," "bottom," "side," "front," "rear," "above," "below," and the like may be used in this specification to describe various example features and elements of the invention, these terms are used herein as a matter of convenience, e.g., based on the example orientations shown in the figures and/or the orientation during typical or conventional use. Nothing in this specification should be construed as requiring a specific three dimensional or relative orientation of structures in order to fall within the scope of this invention.

To assist the reader, this specification is broken into various subsections, as follows: Terms; General Description of Impact-Attenuating Elements and Other Aspects of the Invention; Specific Examples of Impact-Attenuating Elements and Foot-Receiving Device Products According to the Invention; Testing of Specific Example Impact-Attenuating Elements According to the Invention; and Conclusion.

A. Terms

The following terms are used in this specification, and unless otherwise noted or clear from the context, these terms have the meanings provided below.

"Foot-receiving device" means any device into which a user places at least some portion of his or her foot. In addition to all types of footwear (described below), foot-receiving devices include, but are not limited to: bindings and other devices for securing feet in snow skis, cross country skis, water skis, snowboards, and the like; bindings, clips, or other devices for securing feet in pedals for use with bicycles, exercise equipment, and the like; bindings, clips, or other devices for receiving feet during play of video games or other games; and the like.

"Footwear" means any type of product worn on the feet, and this term includes, but is not limited to: all types of shoes, boots, sneakers, sandals, thongs, flip-flops, mules, scuffs, slippers, sport-specific shoes (such as golf shoes, tennis shoes, basketball shoes, baseball cleats, soccer or football cleats, ski boots, etc.), and the like.

"Foot-covering members" include one or more portions of a foot-receiving device that extend at least partially over and/or at least partially cover at least some portion of the wearer's foot, e.g., so as to assist in holding the foot-receiving device on and/or in place with respect to the wearer's foot. "Foot-covering members" include, but are not limited to, upper members of the type provided in some conventional footwear products.

"Foot-supporting members" include one or more portions of a foot-receiving device that extend at least partially beneath at least some portion of the wearer's foot, e.g., so as to assist in supporting the foot and/or attenuating the reaction forces to which the wearer's foot would be exposed, for example, when stepping down in the foot-receiving device. "Foot-supporting members" include, but are not limited to, sole members of the type provided in some conventional footwear products. Such sole members may include conventional outsole, midsole, and/or insole members.

"Ground-contacting elements" or "members" include at least some portions of a foot-receiving device structure that contact the ground or any other surface in use, and/or at least some portions of a foot-receiving device structure that engage another element or structure in use. Such "ground-contacting elements" may include, for example, but are not limited to, outsole elements provided in some conventional footwear products. "Ground-contacting elements" in at least some example structures may be made of suitable and conventional materials to provide long wear, traction, and protect the foot and/or to prevent the remainder of the foot-receiving device structure from wear effects, e.g., when contacting the ground or other surface in use.

B. General Description of Impact-Attenuating Elements and Other Aspects of the Invention

1. Impact-Attenuating Elements

As generally described above, aspects of this invention relate to impact-attenuating elements for attenuating ground or other contact surface reaction forces and the like, e.g., for use in footwear or other foot-receiving devices.

Example impact-attenuating elements in accordance with at least some aspects of this invention may include: (a) a base member, such as an enclosure element at least partially defining at least one fluid-tight or other fluid-containing chamber, the base member defining a first surface and a second surface opposite the first surface; and (b) at least a first support element integrally and contiguously formed in the first surface of the base member. The first support element may include a non-planar surface (e.g., substantially parabolic shaped, cylindrically shaped, etc.) extending into the chamber or other base member and toward its opposite surface, and the non-planar surface further may include at least one reinforcing structure. Any number of support elements with various optional reinforcing structures may be included in the base member without departing from this invention (e.g., laterally adjacent one another, facing one another, extending from either or both of the top and bottom of the base member, etc.). Also, when present as a fluid-containing chamber, the chamber may be filled with any desired fluid, including liquids or gases, such as air, nitrogen, helium, or other gases. The base member or enclosure element may be sized and shaped so as to constitute a portion of an article of footwear, such as an impact-attenuating element for a heel or midsole portion of the article of footwear, an entire footbed, etc.

As additional and/or alternative examples, the support member(s) may have a variety of other features or characteristics as well. For example, in some structures according to the invention, at least some of the support elements will be asymmetrical in some respect (e.g., they may include no line or plane of symmetry). In other examples, at least some of the support elements may have a base edge and a side edge, wherein the base edge is flatter than the side edge (e.g., substantially "D-shaped"). The base edge may extend substantially along a side perimeter of the footbed to thereby help the footbed better and more consistently support the wearer's foot. In still other example structures, particularly when two support elements are arranged facing or opposite one another, the support elements may be structured and/or arranged so as not to constitute mirror images of one another (e.g., they may be twisted or rotated with respect to one another, with different rib or reinforcing structure positions or orientations with respect to one another, with different sizes (e.g., height, width, length, rib sizes, etc.) or shapes with respect to one another, etc.). Wide variations in the support elements and/or their reinforcing structures (when present) are possible without departing from this invention.

The reinforcing structures in the non-planar enclosure element surface may take on a wide variety of different sizes, shapes, and constructions without departing from this invention. For example, the reinforcing structure may constitute a rib element that extends into the base member (e.g., into the fluid-tight or other fluid-containing chamber) from the non-planar surface, e.g., in an angled or spiraled manner. Additionally or alternatively, if desired, the rib element's thickness may taper or otherwise decrease as it moves inward into the base member (e.g., from a largest thickness at or proximate to the first surface of the base member to zero at or near a bottom of the support element's depth, etc.). Also, any desired number of ribs or other reinforcing structures may be included in or on an individual support element without departing from the invention (e.g., two through five ribs, etc.). As yet another example, if desired, the reinforcing structure(s) may take the form of one or more internal rib elements formed on the surface of the support elements and/or extending into an open space defined by the support element.

Impact-attenuating elements in accordance with at least some examples of this invention further may include spring devices engaged with the support element(s) of the base member (e.g., into openings defined by the support elements). The spring devices may include a first body member defining a non-planar surface (e.g., parabolic shaped, etc.) that engages the non-planar surface of the first support element and at least a first reinforcing structure that engages the reinforcing structure(s) of the corresponding support elements.

Impact-attenuating devices according to other example aspects of this invention may include: (a) a base member (e.g., including one or more fluid-tight or other fluid-containing chambers); and (b) one or more spring devices engaged with the base member. At least some of the spring devices may include: (i) a body member defining non-planar first and second surfaces (e.g., parabolic surface(s), etc.), and/or (ii) one or more reinforcing structures for the body member. The reinforcing structure(s) may include one or more raised ribs extending along or from a surface of the first body member (e.g., extending out from the exterior surface, extending in from the interior surface, etc.). The ribs may be angled, spiraled, tapered or otherwise decreasing in thickness (e.g., from the spring device base (e.g., an annular ring) to its crown, etc.), and/or otherwise shaped or constructed in any desired manner without departing from the invention. Any desired number of reinforcing structures may be included on a spring device body member and any desired number of spring devices may be engaged with the base member without departing from this invention. When multiple spring devices are present, they may lie adjacent one another and extend from the same surface of the base member, they may lie facing one another and extend from opposing surfaces of the base member, or both, without departing from this invention.

Impact-attenuating devices according to still additional aspects of this invention may include: (a) a base member (e.g., a fluid-tight or other fluid-containing enclosure element, etc.); (b) a first cup-shaped spring device engaged with the base member, wherein a convex surface of the first cup-shaped spring device includes a first reinforcing structure; and (c) a second cup-shaped spring device engaged with the base member, wherein a convex surface of the second cup-shaped spring device includes a second reinforcing structure. The convex surfaces of the first and second cup-shaped spring devices may face one another (e.g., the spring devices may extend from opposing surfaces of the base member). Any number of spring devices, optionally in opposing pairs as described above, may be included with the base member without departing from the invention. Additionally, any desired number, construction, and arrangement of reinforcing structures may be used on the spring devices without departing from this invention, including the angled, spiraled, or other rib type structures described above. Additionally or alternatively, if desired, one or more reinforcing structures may be provided on an interior surface of the cup-shaped spring devices.

2. Foot-Receiving Device Products

Aspects of this invention also relate to articles of footwear and/or other foot-receiving devices that may include impact-attenuating elements, e.g., of the various types described above. Such foot-receiving device products may include: (a) a foot-covering member (e.g., sandal straps or other footwear upper member structures, etc.); and (b) a foot-supporting member (e.g., sole members or portions thereof, such as midsole elements, insole elements, heel impact-attenuating elements, etc.) engaged with the foot-covering member, wherein the foot-supporting member includes one or more impact-attenuating elements of the various types described above.

The support elements, spring devices, and/or reinforcing structures may be present in any desired numbers in an article of footwear, and/or in any desired individual number of parts, without departing from the invention. Additionally, the reinforcing structures for the integrally and contiguously formed support elements and/or the spring devices may take on any desired forms or structures, including the various internal or external rib structures described above. Also, the foot-receiving device products may take on any desired form, including any desired footwear form or structure, without departing from the invention, including, for example, sandals; athletic shoes; walking shoes; foot-receiving devices for sports, athletic uses, or video game play; etc.

Specific example structures according to the invention are described in more detail below. The reader should understand that these specific examples are set forth merely to illustrate examples of the invention, and they should not be construed as limiting the invention.

C. Specific Examples of Impact-Attenuating Elements and Foot-Receiving Device Products According to the Invention The various figures in this application illustrate examples of impact-attenuating elements useful in systems and methods according to examples of this invention. When the same reference number appears in more than one drawing, that reference number is used consistently in this specification and the drawings to refer to the same or similar parts throughout.

Figure 1B:
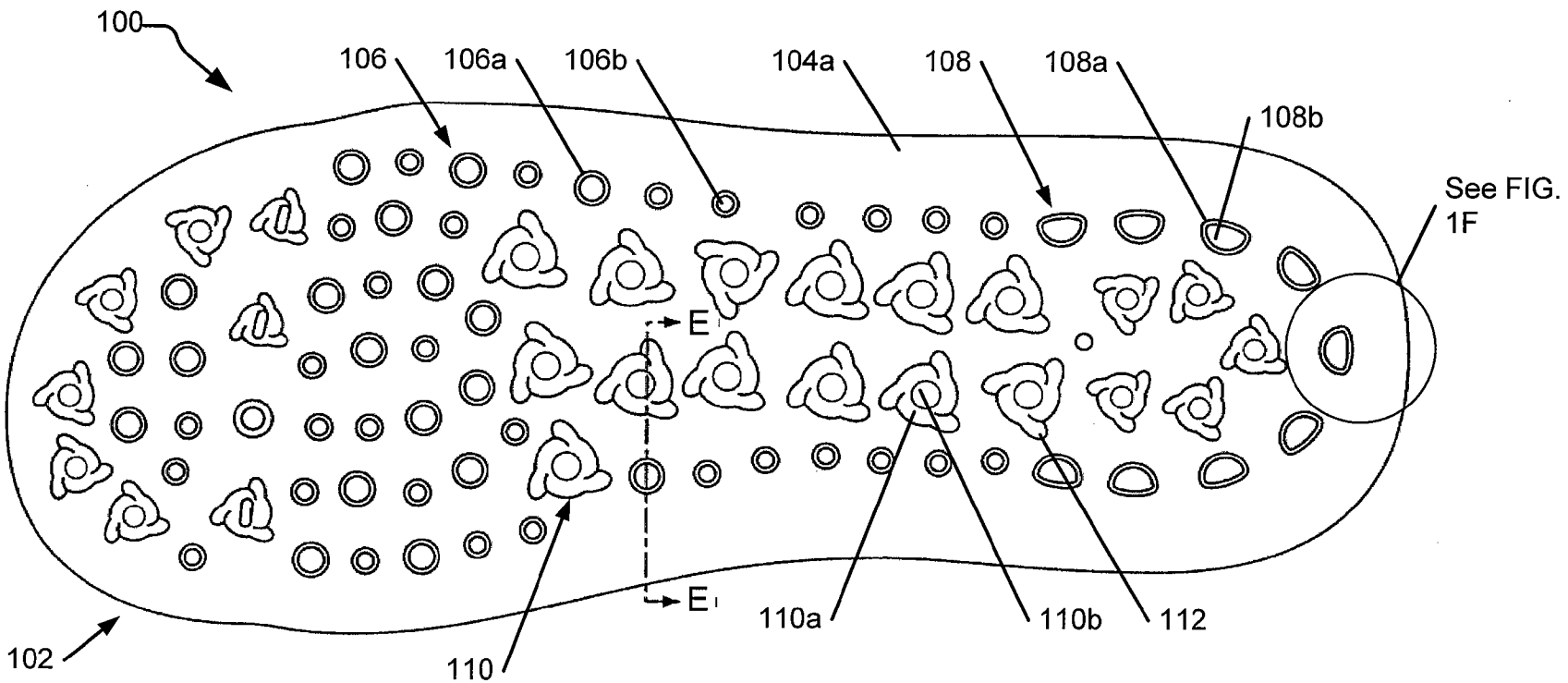
Figure 1C:
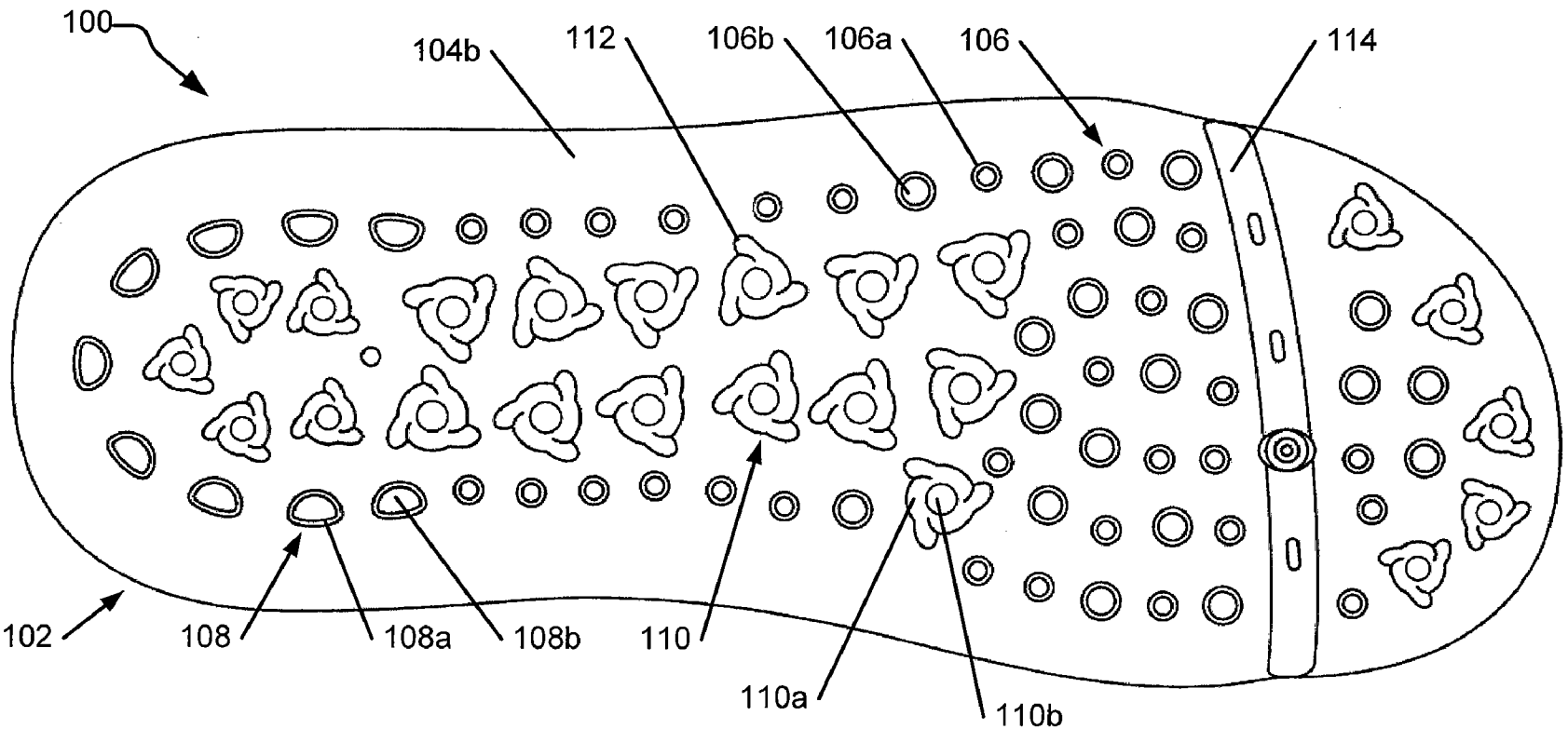
Figure 1D:
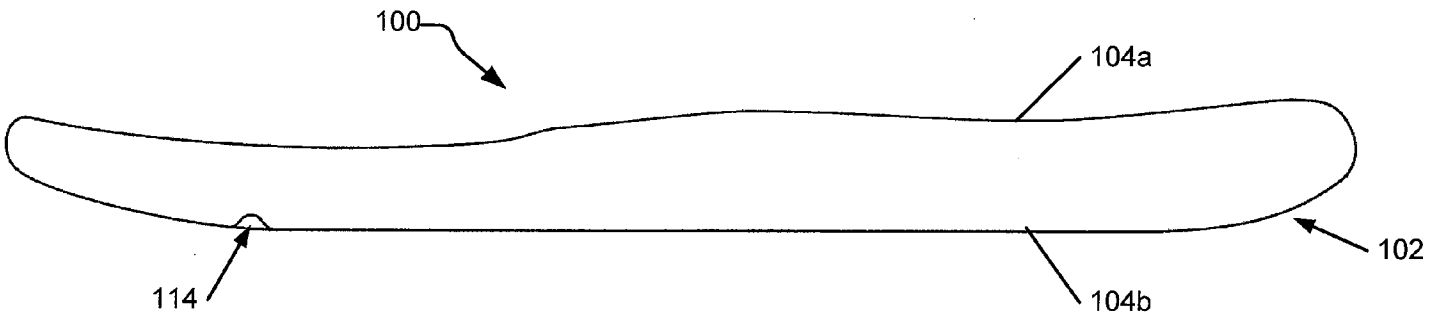

1. Example Impact-Attenuating Elements and Foot-Receiving Device Products Including Such Elements FIGS. 1A through 1E illustrate various views of an example impact-attenuating element in accordance with some examples of this invention. In this example structure, the impact-attenuating element is in the form of a foot-support structure or footbed 100 (FIG. 1A illustrates a perspective view, FIG. 1B illustrates a top view, FIG. 1C illustrates a bottom view, FIG. 1D illustrates a side view, and FIG. 1E illustrates a cross-sectional view taken along lines E-E of FIG. 1B). The footbed 100 of this example structure is in the form of a fluid-containing bladder 102. The bladder 102 includes an exterior wall member 102*a* that defines one or more interior and/or interconnected chambers 102*b* (e.g., fluid-containing chambers) that may be filled with a gas or other fluid. The bladder 102 further is constructed and shaped to include two major surfaces, a top major surface 104*a* and a bottom major surface 104*b* opposite the top major surface 104*a*.

The bladder 102 may be made of any desired materials, formed in any desired manner (e.g., polymeric materials formed by blow molding, etc.), without departing from this invention. As some more specific examples, the bladder 102 may be made from resilient, thermoplastic, elastomeric barrier films, such as polyester polyurethanes, polyether polyurethanes (such as cast or extruded ester based polyurethane films, e.g., Tetra Plastics TPW-250); thermoplastic urethanes, such as PELLETHANE™ (a product of the Dow Chemical Company of Midland, Mich.), ELASTOLLAN® (a product of the BASF Corporation), and ESTANE® (a product of the B. F. Goodrich Co.), all of which are either ester or ether based); thermoplastic urethanes based on polyesters, polyethers, polycaprolactone, and polycarbonate macrogels; thermoplastic films containing crystalline material, such as those disclosed in U.S. Pat. Nos. 4,936,029 and 5,042,176 to Rudy, each of which is entirely incorporated herein by reference; polyurethane including a polyester polyol, such as those disclosed in U.S. Pat. No. 6,013,340 to Bonk et al., which is entirely incorporated herein by reference; and/or multi-layer films formed of at least one elastomeric thermoplastic material layer and a barrier material layer formed of a copolymer of ethylene and vinyl alcohol, such as those disclosed in U.S. Pat. No. 5,952,065 to Mitchell et al., which also is entirely incorporated herein by reference. Fluid-containing bladder materials and/or members of the types used in "AIR" type footwear products and/or other footwear products commercially available from NIKE, Inc. of Beaverton, Oreg. also may be used as fluid-containing bladder 102 without departing from this invention.

Any gas or other fluid may be used to fill the interior chamber(s) 102*b* of the bladder 102 without departing from this invention, including air, inert gases, liquids, etc. The filling gas or fluid may be under pressure, under vacuum, or under standard or atmospheric conditions without departing from this invention. As desired, the fluid-containing bladder 102 may be sealed or vented to the atmosphere.

The fluid-containing bladder 102 may be flexible, such that it readily conforms to the shape of the space into which it is fit, it may be somewhat conformable, it may be relatively rigid, such that it substantially holds its shape under applied force, or it may be very rigid. Such rigidity/conformability features may depend on the overall structure of the bladder 102, such as its wall thicknesses; materials; molding structures or features; the presence or absence of support structures, e.g., molded into bladder 102, as separate elements, etc.; the distribution of support structures; etc. Also, any number of independent chambers (optionally interconnected chambers) may be provided in a single fluid-containing bladder 102 and/or any number of fluid-containing bladders 102 may be provided in an overall footbed structure 100 and/or in an overall foot-receiving device product without departing from this invention. Also, while the illustrated example structure 100 shows the bladder 102 sized and shaped so as to form a footbed for supporting an entire plantar surface of a user's foot (or substantially the entire plantar surface of the foot (e.g., at least 75%, and in some examples at least 90% or even 95%)), those skilled in the art will recognize that the bladder 102 may be sized and shaped so as to support only a portion of a user's foot, such as only the heel area, only the arch area, only the toe area, etc.

The top major surface 104*a* of the footbed structure 100 further includes plural support elements 106, 108, and 110 integrally and contiguously formed therein (e.g., directly molded into and with the material forming the top major surface 104*a* of the bladder structure 102). In the illustrated examples, the support elements 106, 108, and 110 include surfaces 106*a*, 108*a*, and 110*a*, respectively, that extend into the fluid-containing chamber of the bladder 102 (e.g., from the top major surface 104*a* toward the bottom major surface 104*b* and from the bottom major surface 104*b* toward the top major surface 104*a*).

The support elements 106, 108, and 110 may take on a wide variety of structures without departing from the invention. For example, as illustrated in FIGS. 1A through 1C and 1E, support elements 106 are generally cylindrically shaped (optionally right cylindrical or essentially right cylindrical), having a bottom surface 106*b* and the side wall surface(s) 106*a*. While the overall height or depth of the cylinder structure may vary without departing from the invention (e.g., up to 100% of the overall depth), in at least some examples or at least at some locations in the footbed structure 100, as illustrated in FIG. 1E, the depth may be in a range of approximately 5% to 95%, 10% to 90%, 20% to 80%, 30% to 70%, or even 40 to 60% of the overall depth of the fluid-containing bladder 102. Also, as shown by FIG. 1E, in at least some locations, a support structure 106 extending from one major surface 104*a* of the fluid-containing bladder 102 may lie immediately adjacent and opposite a corresponding support structure, optionally of the same size, shape, and/or orientation, extending from the opposite major surface 104*b* of the fluid-containing bladder 102. Each opposing support structure 106 may extend up to 100% of the overall total depth of the fluid-containing bladder structure 102, and in some examples, in a range of from approximately 5% to 95%, 10% to 90%, 20% to 80%, 30% to 70%, or even 40% to 60% of the total depth.

Cylindrical support elements need not have a round cross section like support elements 106. Rather, as illustrated in FIGS. 1A through 1C, at least some of the cylindrical support elements 108 in this example structure 100 have a generally "D"-shaped cross section (e.g., generally cylindrically shaped (optionally right cylindrical or essentially right cylindrical), having a bottom surface 108*b* and side wall surface(s) 108*a*. Again, while the overall height or depth of the cylinder structure 108 may vary without departing from the invention (e.g., up to 100% of the total fluid-containing bladder 102 height), in at least some examples, the depth may be in a range of from approximately 5% to 95%, 10% to 90%, 20% to 80%, 30% to 70%, or even 40-60% of the overall depth of the fluid-containing bladder 102. Also, as evident by a comparison of the top and bottom views of FIGS. 1B and 1C, in at least some locations, a support structure 108 extending from one major surface 104*a* of the fluid-containing bladder 102 may lie immediately adjacent and opposite a corresponding support structure, optionally of the same size, shape, and/or orientation, extending from the opposite major surface 104*b* of the fluid-containing bladder 102. While not a requirement, the D-shaped support elements 108 in this example structure 100 primarily encircle the perimeter of the heel area of the overall footbed 100, with the flatter portion of the "D" pointing outward.

Figure 1F:
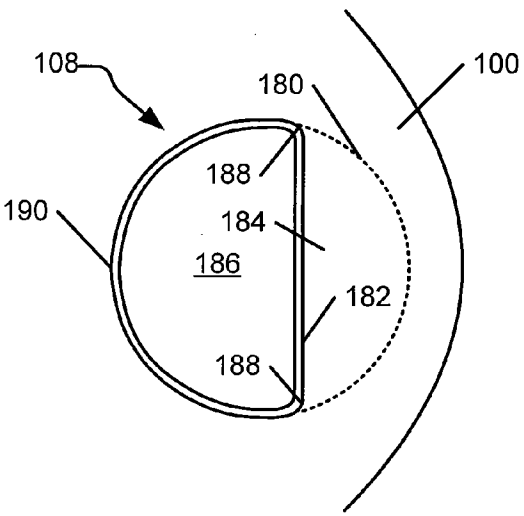
Figure 1E:
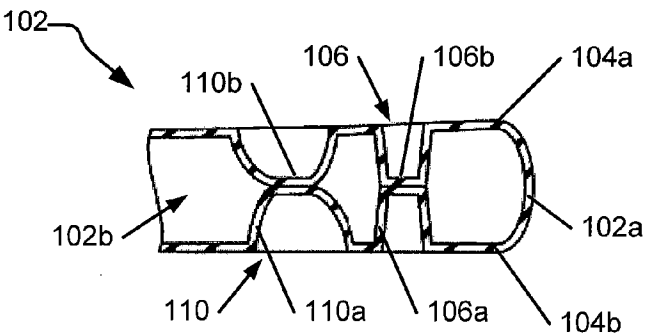

An overhead view of an example D-shaped support element 108 is provided in FIG. 1F. As shown, in at least some examples of this invention, the D-shaped support elements 108 may be considered as constituting a generally cylindrical or conically shaped support element with a generally round cross section (signified by the broken line circle 180 of FIG. 1F). The flattened portion 182 of the "D" structure in this example is formed by an internal rib or other reinforcing member structure 184 that at least partially fills in a portion of the open interior space 186 defined by the cylinder or conical structure 180. While it may, the reinforcing member structure 184 need not extend the entire depth (into the page of FIG. 1F) of the support structure 108, nor does it have to maintain a constant cross-sectional area throughout its depth (e.g., it may end before the bottom of the cylinder, it may be angled or tapered, it may have a variety of shapes, etc.).

The D-shape of support elements 108 provides certain features that may not be available with conventional, symmetrical right cylindrical or conical shaped support members having a round cross section (e.g., like support members 106). More specifically, right cylindrical or conical support member structures with round cross sections typically have a relatively high initial stiffness under an applied load and then collapse under higher loads. Because of their symmetrical, round cross sections, these support elements 106 do not collapse in a regular, consistent and repeatable manner. The D-shaped support elements 108, on the other hand, have added areas of reinforcement provided by the corners 188 of the internal rib member structure 184, near the transition region from the rounded main wall 190 to the flattened portion 182 of the "D." The added areas of reinforcement provided by the corners 188 produces a support structure 108 having a preferential and more consistent buckle direction or location (i.e., the support structure 108 will preferentially and more consistently buckle along wall 190 and remain unbuckled or stiffened along flattened portion 182). By placing the flattened portions 182 of the D-shaped support structures 108 along the peripheral edge of the heel and closer to the peripheral edge than the main wall 190, e.g., as shown in FIGS. 1A-1C, the outer perimeter of the footbed 100 will remain stable and the collapsing support structures 108 will consistently direct the weight of the wearer's foot toward the central portion of the footbed 100. Of course, D-shaped support members 108 of the types described above may be provided at any desired locations in an overall footbed structure 100.

Another support member structure 110 is illustrated in the example footbed 100 of FIGS. 1A through 1E. Support structures 110 include a non-planar side wall surface 110*a*, which in this illustrated example structure 100 is parabolic shaped. Other shapes also are possible, such as hemi-elliptical, hemi-oval, rounded, irregularly shaped, etc. The parabolic (or other) shaped side wall 110*a* extends to a bottom surface 110*b*, which in this example structure 100 is located approximately 40-50% into the overall depth of the footbed structure 100 (although it may be located at any desired depth, such as up to 100% of the overall height of the footbed structure 100, and in some examples, in a range of from approximately 5% to 95%, 10% to 90%, 20% to 80%, 30% to 70%, or even 40% to 60% of the overall height). Like the other support structures 106 and 108 described above, the support structures 110 may lie immediately adjacent and opposite support structures extending into the footbed 100 from the opposing major surface, optionally support structures of the same general size, shape, and/or orientation as support structures 110. Of course, if desired, a support structure of any type (e.g., 106, 108, and/or 110) may lie adjacent and/or opposite support structures of different sizes, shapes, and/or orientations extending from the opposite surface and/or with no directly opposing and/or adjacent support structures. The support structures need not have a line or plane of symmetry. Moreover, the support structures on one level need not constitute mirror images of the adjacent corresponding support structures on the opposite level.

In addition to the parabolic shaped side wall surfaces 110*a*, the support elements 110 may include at least one reinforcing structure. In this illustrated example, the reinforcing structure takes the form of one or more reinforcing rib members 112 contiguously formed with and extending from the side surface 110*a* of the support elements 110 (e.g., further into the fluid-containing bladder 102). The overall support element 110 is asymmetric, e.g., it has no line or plane of symmetry.

Many variations in the reinforcing structure(s) are possible without departing from this invention. For example, a support structure 110 may include any number of reinforcing structures (e.g., any number of rib members 112 or the like), without departing from the invention, and such reinforcing structures 112 may be arranged in any desired manner without departing from the invention. For example, an individual support structure 110 may have 1-8 rib structures 112, and in some examples 2-5 rib structures 112, without departing from the invention. In at least some examples of the invention, when plural reinforcing structures 112 are provided, the reinforcing structures 112 may be evenly spaced around the support structure surface 110*a*. In the example structure illustrated in FIGS. 1A through 1C, the support structures 110 include three essentially evenly spaced ribs 112.

Rib reinforcing structures 112 of the type illustrated in FIGS. 1A through 1C also may have a wide variety of different structures and characteristics without departing from this invention. For example, the overall "thickness" of the rib 112 (e.g., the distance from the support structure's side wall 110*a* to the rib structure's most remote or distant location (e.g., akin to dimension "$T_{ib}$" to be discussed in more detail below with reference to FIG. 7B)) may vary widely without departing from the invention (e.g., from 0.5 mm thick or less to 6 mm thick or greater, and in some examples, from 1.5 to 4 mm thick). Additionally, this dimension may remain constant or it may vary over the overall length of an individual rib structure 112 without departing from the invention. In some example structures, the thickness of an individual rib structure 112 will be largest at or proximate to the major surface 104*a* or 104*b* of the footbed 100, and it may gradually reduce its thickness (or taper) to zero thickness at or proximate to the bottom surface 110*b* of the support structure 110. The rib thickness may change in a smooth, constant, tapered manner, in a stepwise manner (in steps of the same or different sizes), or in some other manner, e.g., in an irregular manner, without departing from the invention. Also, while the rib thickness may decrease over some portion of the rib structure's 112 length (e.g., moving from the major surface 104*a* or 104*b* toward the bottom surface 110*b*), the same rib structure 112 also may increase in thickness over some portion of its length (e.g., moving from the major surface 104*a* or 104*b* toward the bottom surface 110*b*), without departing from the invention. The rib structures 112 also need not begin directly at the major surface 104*a* or 104*b* and/or they need not extend all the way to the bottom surface 110*b*, although they may have either or both of these characteristics without departing from this invention.

While they may do so in at least some examples of the invention, the ribs or other reinforcing structures 112 need not extend along the wall member 110*a* in a straight line directly from the major surface 104*a* or 104*b* toward the bottom surface 110*b*. Rather, if desired, in at least some example structures in accordance with this invention, the ribs or other reinforcing structures 112 may wrap or extend along the wall member 110*a* in an angled or spiraled manner (e.g., Archamede spiraled, angled 0-60° from vertical with respect to the direction directly from the major surface 104*a* or 104*b* toward the bottom surface 110*b* or the like). In some examples, the spiral or other angling will be about 20-45° from vertical with respect to the direction directly from the major surface 104*a* or 104*b* toward the bottom surface 110*b* or the like.

Also, while each rib structure and/or other reinforcing element structure 112 may be identical in a given support member 110, this is not a requirement. Rather, if desired, one or more ribs 112 on a given support member 110 may differ from at least some of the other ribs (e.g., in one or more of the various characteristics described above, such as in its thickness characteristics, its thickness change characteristics over rib length (if any), its rib location characteristics, total rib number, rib angling or spiraling characteristics, etc.). Moreover, not all support members 110 on a given footbed 100 need have the same characteristics. For example, FIGS. 1A through 1C illustrate support members 110 on the footbed 100 having different outer diameters, different rib sizes, and the like. Of course, any desired characteristics of the support members 110 and/or their reinforcing structures 112 may be provided on a given footbed 100, including differences between one major surface 104*a* as compared to the other 104*b*, without departing from this invention.

Other variations in the reinforcing structures 112 are possible without departing from the invention. As another example, if desired, the rib structures 112 may extend inward into the open space defined between the support structure walls 110*a*. Also, combinations of inwardly and outwardly extending reinforcing structures may be provided on a given support 110 and/or on a given footbed 100 without departing from the invention.

While support structures 110 may be located at any desired positions in the footbed structure 100, in this illustrated example, these support structures 110 are provided at locations requiring a relatively large amount of support, such as in the heel area, the arch area, and the front toe area. While not illustrated, if desired, all of the support structures of a given footbed may be of the type shown by reference number 110 (e.g., if desired, support structures 106 and/or 108 may be omitted in favor of support structures 110) without departing from this invention.

Footbed 100 further may include features that enable it to provide a more comfortable surface for walking, other ambulatory activity, or other uses. For example, as illustrated in FIG. 1D, the major surfaces 104*a* and/or 104*b* may be contoured to provide support for the foot, e.g., in a manner similar to foot-supporting structures in conventional articles of footwear. Moreover, one or more of the surfaces 104*a* and 104*b* may include "bend" areas 114, e.g., provided to make the footbed 100 more easily bend at locations corresponding to places of a user's foot at which significant bending takes place. FIGS. 1A, 1C and 1D illustrate a bend area 114 extending from the lateral side to the medial side of the footbed 100 at or near the wearer's toe line, to better promote bending of the footbed 100 near the wearer's toes. While a variety of structures may be provided as a "bend" area 114, in this illustrated example, the bend line 114 constitutes an arched section extending across the footbed with the material of the footbed omitted in the arched section. This structure 114 allows easier stretch of the footbed 100 as the toe area bends during a step and returns to substantially its original shape and orientation as the user's foot lifts off the ground during the step. Of course, "bend" areas (e.g., similar to area 114) may be provided in other areas of the footbed 100, if desired, for example, extending in the longitudinal direction (e.g., for a golf shoe type footbed, etc.), etc.

Figure 2A:
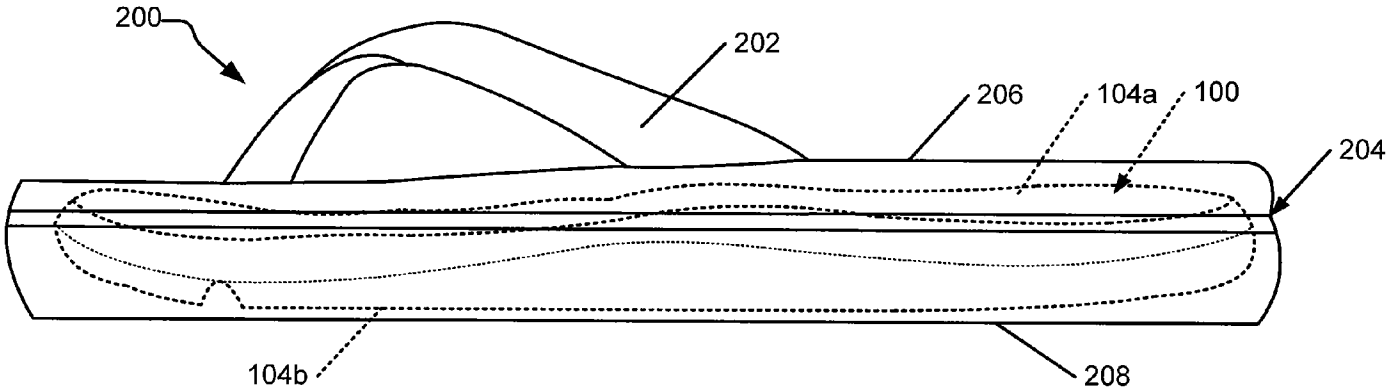
FIGS. 2A and 2B illustrate an example footwear product, in the form of a sandal, including a footbed product of the general type illustrated in FIGS. 1A through 1E.
Figure 2B:
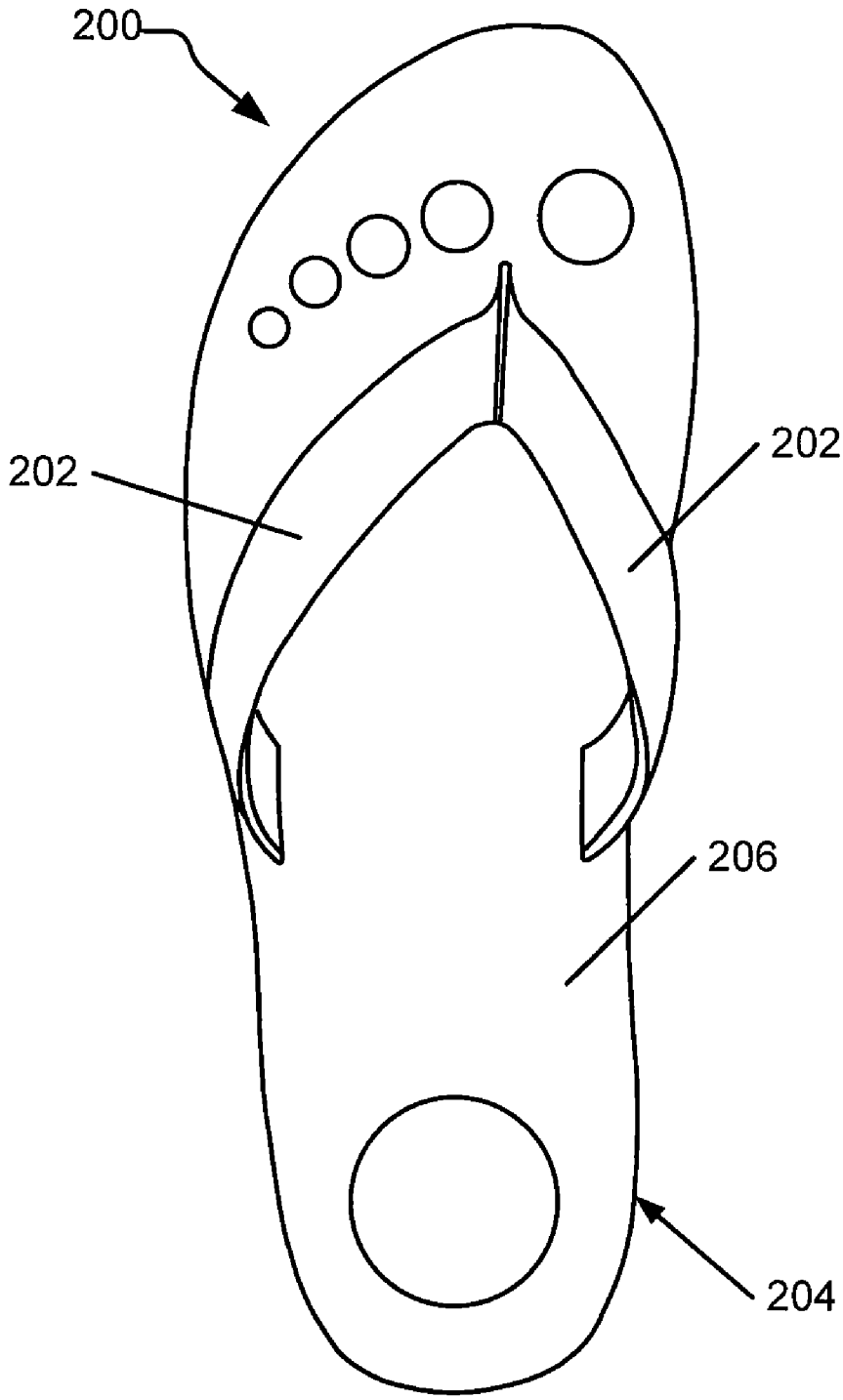

FIGS. 2A and 2B illustrate an example article of footwear 200 in which a footbed 100 of the type illustrated in FIGS. 1A through 1E is provided. This example article of footwear 200 is in the form of a sandal, and it includes an upper member 202 (in the form of one or more foot-retaining straps in this example structure 200) and a sole structure 204 (including the footbed 100) engaged with the upper member 202. Any manner of engaging the upper member 202 and the sole structure 204 may be used without departing from this invention, including: adhesives or cements; fusing techniques; stitching or sewing; mechanical connectors or retaining element structures; and the like. Conventional ways of attaching the upper member 202 and the sole structure 204 also may be used without departing from this invention.

As mentioned above, the sole structure 204 includes a footbed 100 of the type described above in conjunction with FIGS. 1A through 1E. The footbed 100, which may constitute at least part of a midsole element or an insole element for the article of footwear 200, may be incorporated into the sole structure 204 in any desired manner without departing from this invention, such as within part of a foam midsole structure, fit into a chamber defined in an outsole, midsole, or other sole structure, etc. Also, while the top major surface 104*a* may directly contact the wearer's foot in use, if desired, the top major surface 104*a* may be covered by another member 206, such as a layer of fabric or other material, a polymer layer, a foam layer, an insole layer, a sock-liner layer, an interior footwear bootie member layer, etc. The bottom major surface 104*b* may be covered, housed, or encased in a portion of the sole structure 204 including an outsole member 208, which may be constructed from materials designed to provide traction and wear resistance when contacting the ground. An outsole member 208 may be glued or otherwise attached to the footbed structure 100 or to a midsole or other sole member including the footbed. As still another example, if desired, multiple outsole elements or patches may be adhered or otherwise engaged at multiple locations on the bottom major surface 104*b*, such that portions of the bottom major surface 104*b* remain exposed in the final footwear product.

While FIGS. 2A and 2B illustrate the article of footwear 200 as a sandal, those skilled in the art will understand that any type of article of footwear may include a footbed structure 100 of the types illustrated in FIGS. 1A through 1E, including a wide variety of sandal structures, athletic shoes (e.g., as part of a midsole structure), dress shoes, work boots, walking shoes, and the like. Any desired upper member and/or sole structure constructions and materials may include footbed structures of the type described above, and any footwear construction and design may be provided with such a footbed structures, including conventional upper members, sole structures, and footwear materials, constructions, and designs as are known and used in the art. Also, as noted above, the footbed structure 100 provided in such articles of footwear need not support the wearer's entire foot, but rather, they may support one or more portions of the foot, such as one or more of the heel area, the arch area, the toe area, etc. Also, if desired, an individual article of footwear may include independent footbed structures at different locations without departing from the invention, such as one footbed structure in the heel area and another, separate footbed structure in the toe area.

Figure 3A:
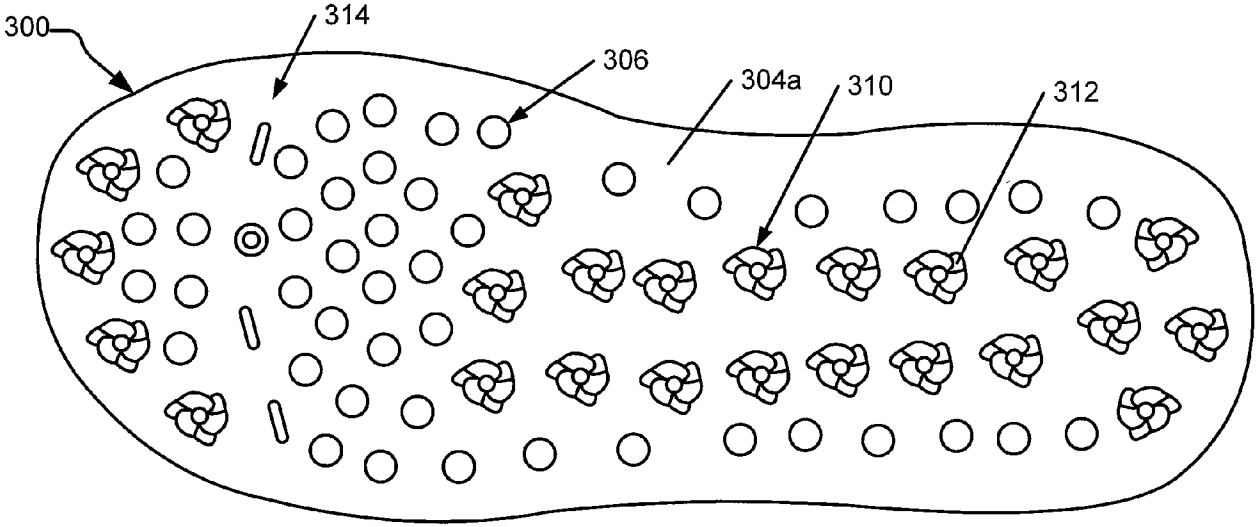
FIGS. 3A through 3C illustrate various views of another example impact-attenuating element in accordance with this invention in the form of a footbed for supporting essentially an entire plantar surface of a wearer's foot.
Figure 3B:
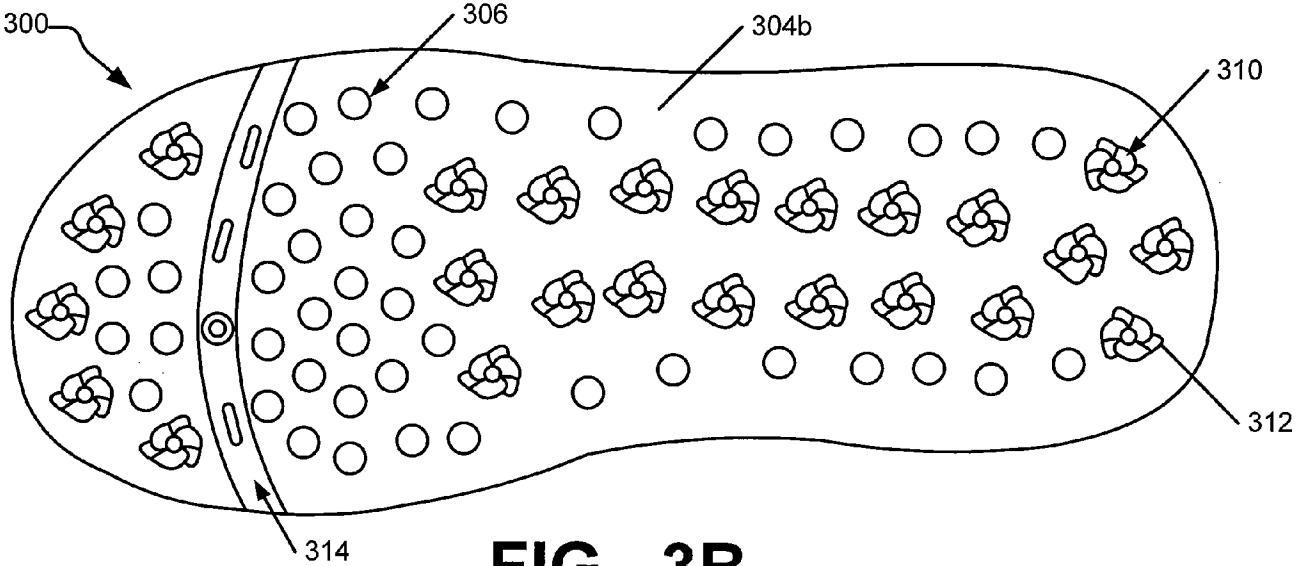
Figure 3C:
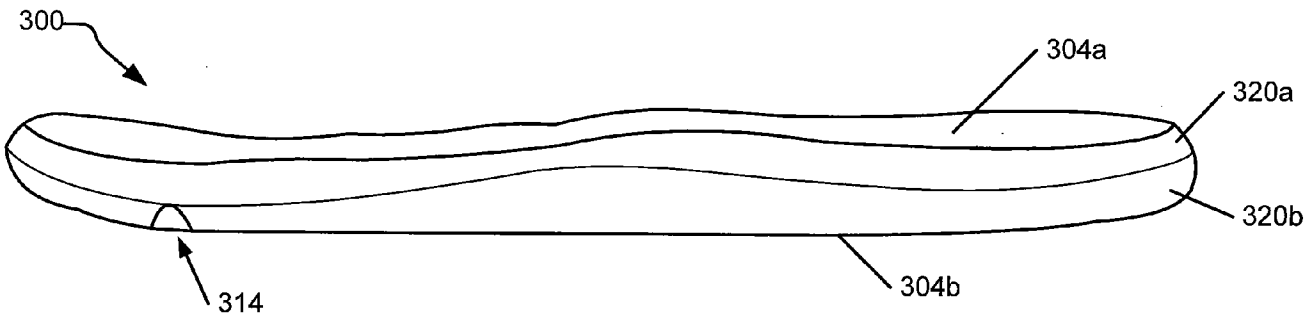

As mentioned above, a wide variety of support structure styles and/or arrangements in a footbed structure are possible without departing from this invention. FIGS. 3A through 3C illustrate another example. In the footbed structure 300 of FIGS. 3A through 3C, the footbed structure 300 is formed as a fluid-containing bladder (of the type illustrated in FIGS. 1A through 1E), and FIG. 3A illustrates the top major surface 304*a*, FIG. 3B illustrates the bottom major surface 304*b*, and FIG. 3C illustrates a side view. One difference in the footbed structures 100 and 300 lies in the structure and arrangement of the support structures. More specifically, footbed structure 300 includes support structures 306 and 310 (which are similar to support structures 106 and 110, respectively, as described above), and support structures of the type 108 have been omitted. The parabolic shaped support structures 310 (including their corresponding rib structures 312) mainly support the heel, arch, and toe areas of the foot, while the generally cylindrical support structures 306 support areas between the parabolic shaped support structures 310, along the side edges of the footbed 300, and in the area behind the wearer's toes. Certain differences in the bend line structure 314 also may be seen by comparing the figures.

While the example structure 300 of FIGS. 3A and 3B shows the various support structures 306 and 310 and the rib structures 312 of a common size and arrangement, those skilled in the art will appreciate that various different sizes and arrangements of the support structures, including sizes and arrangements of the support structures 306 and 310 on the top major surface 304*a* as compared to the bottom major surface 304*b*, may vary widely without departing from this invention. For example, any of the potential structures and/or arrangements of support structures 106, 108, and 110, and/or the rib structures 112 as described above in conjunction with FIGS. 1A through 1E, may be used in the footbed structure 300 of FIGS. 3A through 3C without departing from this invention.

Also, FIG. 3C illustrates that the footbed 300 optionally may be made of plural independent fluid-containing bladder elements 320*a* and 320*b* that optionally are fixed together, e.g., using cements or adhesives; fusing techniques (melting, welding, etc.); mechanical connectors and/or retaining element structures; etc. Optionally, if desired, one or more independent parts (e.g., upper and lower bladder elements 320*a* and 320*b*, respectively) may be separately fixed in an overall footwear structure (e.g., into another portion of the upper or sole structure), without departing from this invention. Any number of individual bladder elements (e.g., 320*a* and 320*b*) may be provided in an overall bladder structure 300, divided in any manner or direction, without departing from the invention.

In the example impact-attenuating element structures described above, the support structures (e.g., 106, 108, 110, 306, and 310) were integrally and contiguously formed in the structure of the footbed member (e.g., formed as part of a fluid-containing bladder structure during molding of the bladder). Those skilled in the art will appreciate, however, that the base for the footbed need not constitute a fluid-containing bladder. Rather, if desired, the footbed may constitute a piece of foam or other impact-attenuating material (such as ethylvinylacetate, polyurethane, phylon, phylite, etc.) with support members of the types described above formed therein. The support areas may be treated, if desired, to make the foam somewhat stiffer or softer at those locations.

Additionally or alternatively, if desired, at least some of the open spaces defined by the support structures (e.g., 106, 108, 110, 306, and 310) may be filled with an additional material, such as foam or other impact-attenuating material (such as ethylvinylacetate, polyurethane, phylon, phylite, etc.), plastic materials, and the like. In some more specific examples, and as will be described in more detail below in conjunction with FIGS. 7A through 11, at least some of the open spaces defined by the support structures (e.g., 106, 108, 110, 306, and 310) may be filled with spring devices (e.g., made from plastics or other suitable materials).

Figure 4:
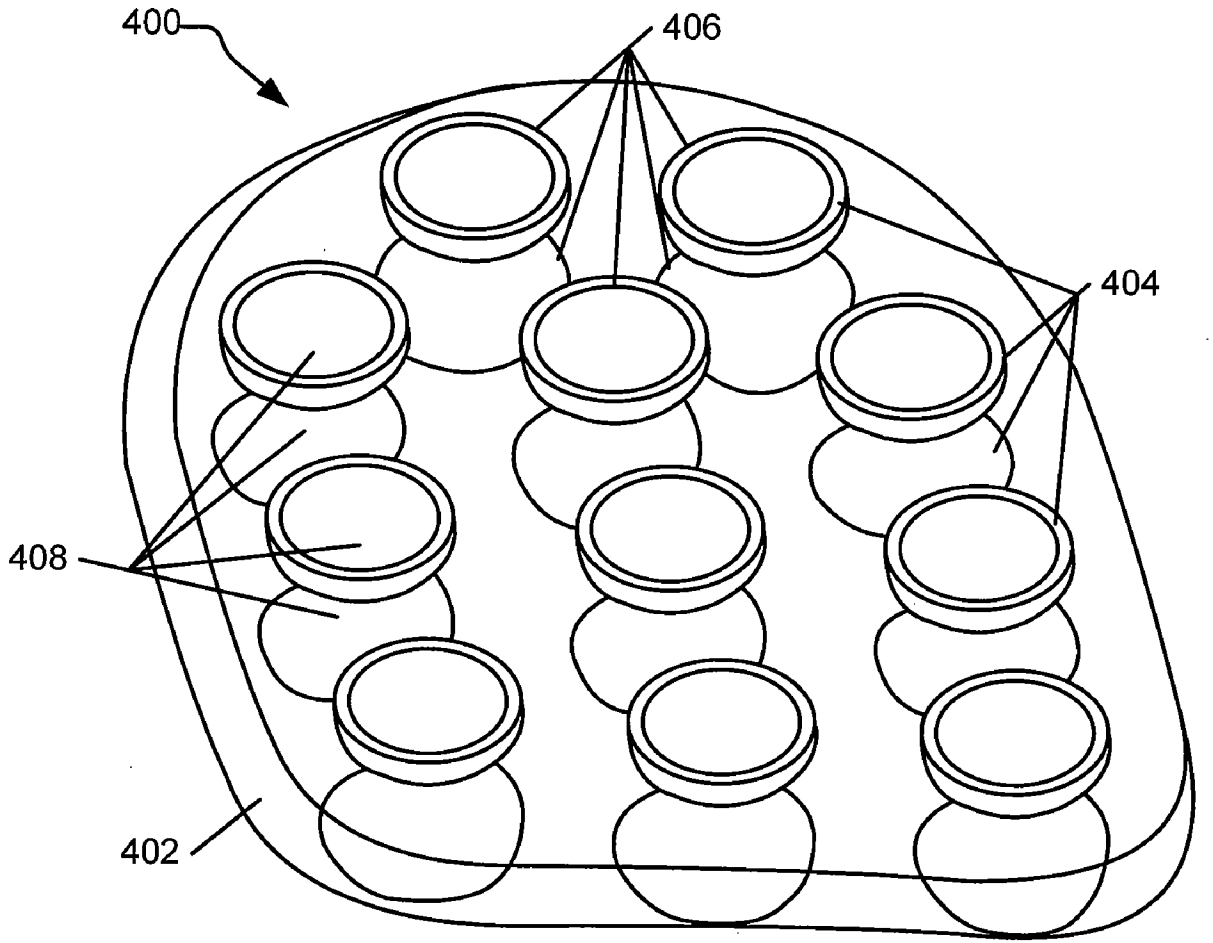
FIG. 4 illustrates an example impact-attenuating element for the heel portion of footwear products.
Figure 5:
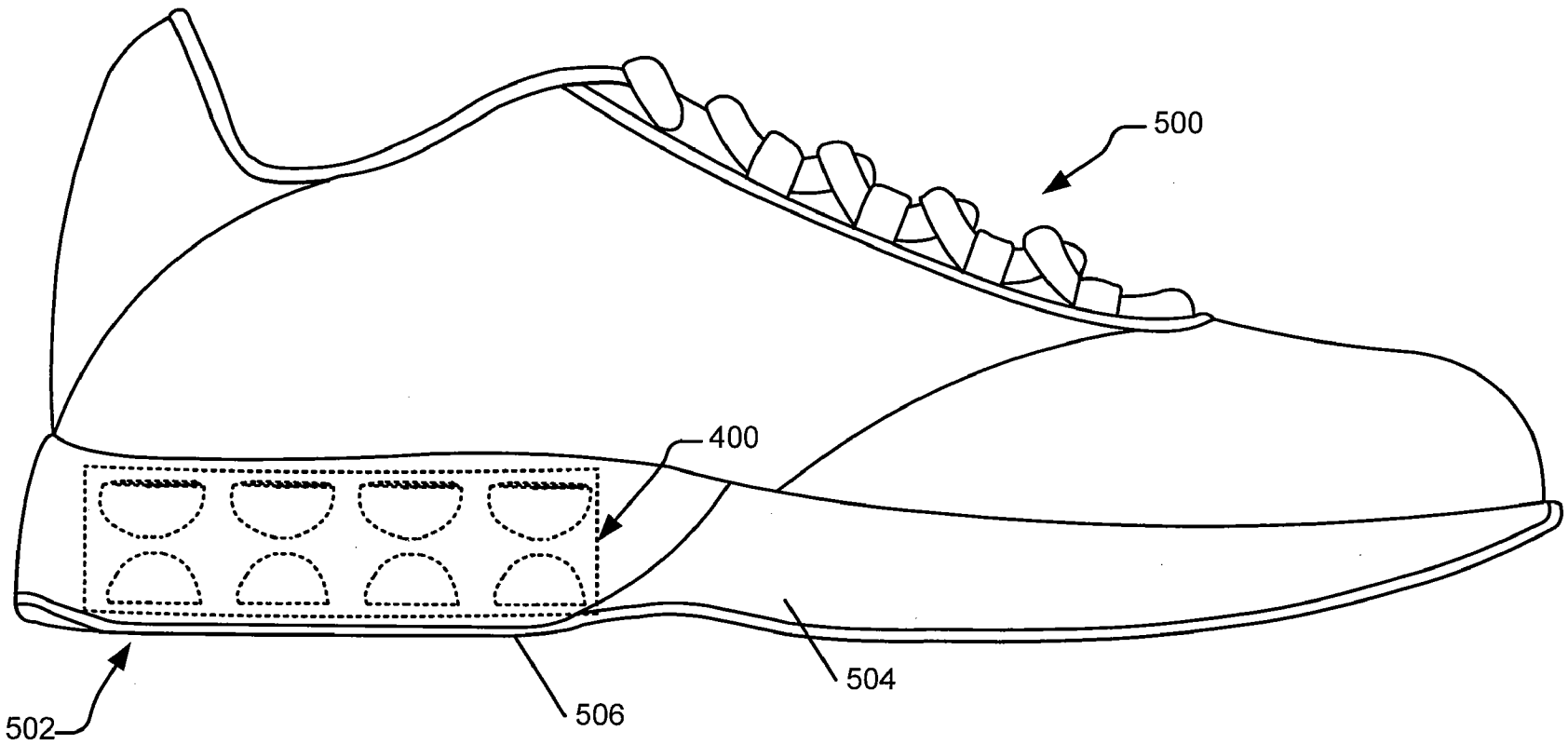
FIG. 5 illustrates an example arrangement of the impact-attenuating element of FIG. 4 in a piece of footwear.
Figure 6:
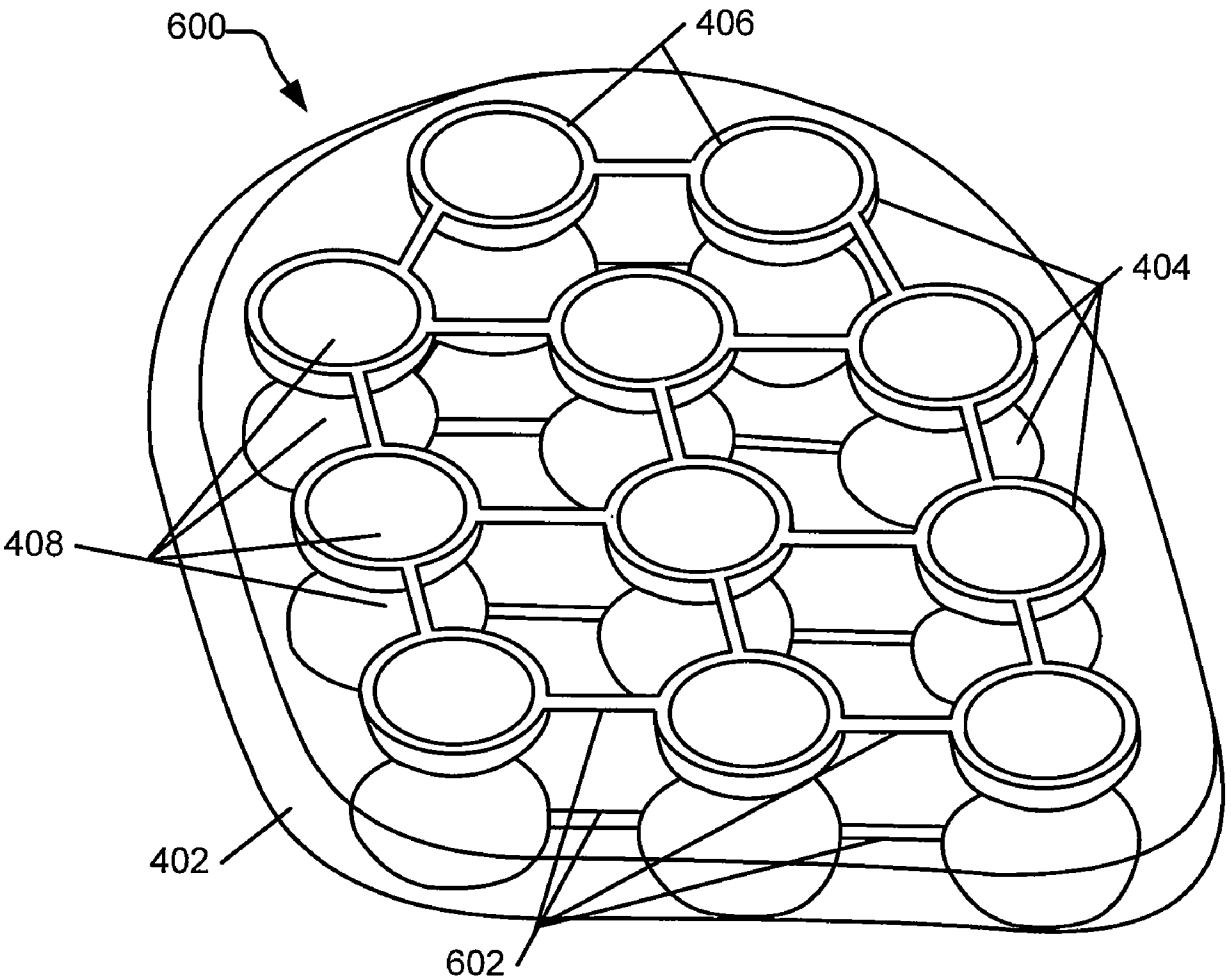
FIG. 6 illustrates another example impact-attenuating element for the heel portion of footwear products.

2. Example Impact-Attenuating Elements Including Additional Spring Devices and Foot-Receiving Device Products Including Such Elements FIGS. 4-6 illustrate various sample fluid-containing bladder type impact-attenuating elements that include additional support members. These impact-attenuating elements were used for comparison purposes for impact-attenuating elements including spring devices in accordance with some examples of this invention.

More specifically, FIG. 4 illustrates an example heel "puck-type" fluid-containing bladder device 400 that may be included in the heel area of footwear structures. The bladder device 400 includes a fluid-containing enclosure element or envelope 402 on (or in) which a plurality of independent spring devices 404 are mounted. In the illustrated example, a top half of the enclosure envelope 402 includes eleven spring devices 404 (arranged in three rows of three and one row of two), and the bottom half of the enclosure envelope 402 likewise includes eleven spring devices 404 arranged opposite those in the top half. The bodies of these spring devices 404 are generally cup-shaped, each spring device 404 having a base area 406 (e.g., the wider, open end) and a crown area 408 (e.g., the smaller, closed end opposite the base area 406). The top and bottom spring devices 404 are arranged such that their crown areas 408 face one another and their base areas 406 face away from one another and toward the outside of the enclosure envelope 402. The base areas 406 open to an interior chamber.

As is known in the art, puck-type bladder devices 400 of the type illustrated in FIG. 4 fit into a sole member 502 of an article of footwear 500, as illustrated in FIG. 5. In the illustrated example, the bladder device 400 fits in the heel area of the footwear article 500 as part of a midsole structure 504, e.g., a portion of the sole member 502 between the outsole member 506 and an interior insole portion or sock liner of the shoe 500 (not shown in FIG. 5).

FIG. 6 illustrates another example "puck-type" bladder device 600 that may be used in footwear structures (e.g., in the manner shown in FIG. 5). As evident from FIG. 6 and the use of reference numbers the same as those used in FIG. 4, the structure of bladder device 600 is similar to that shown in FIG. 4. However, the structure 600 of FIG. 6 includes runner elements 602 extending between the base areas 406 of some of the adjacent spring devices 404.

In bladder devices like devices 400 and 600 illustrated in FIGS. 4 and 6, the firmness or stiffness of the overall device is largely dependent on the wall thicknesses of the cup-shaped spring devices 402. To provide a firmer structure, thicker spring devices 402 must be used. When a spring device (e.g., devices 402) reaches an overall wall thickness of about 3 mm (e.g., such as for use in basketball), these thicker or stiffer spring devices 402 have a limited maximum achievable displacement, which can significantly decrease the spring device's ability to manage energy during impact with the ground or other contact surface. Therefore, in these bladder device designs, a trade-off exists between stiffness and other performance variables. It would be desirable to provide impact-attenuating devices in which this "trade-off" between stiffness and maximum possible deflection is reduced.

Figure 7A:
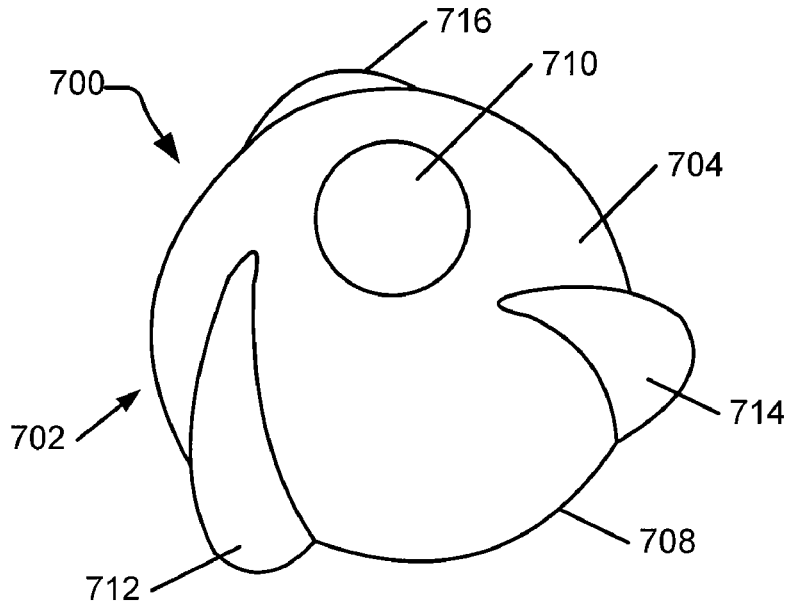
FIGS. 7A and 7B illustrate an example spring device that may be included in impact-attenuating elements in accordance with this invention.
Figure 7B:
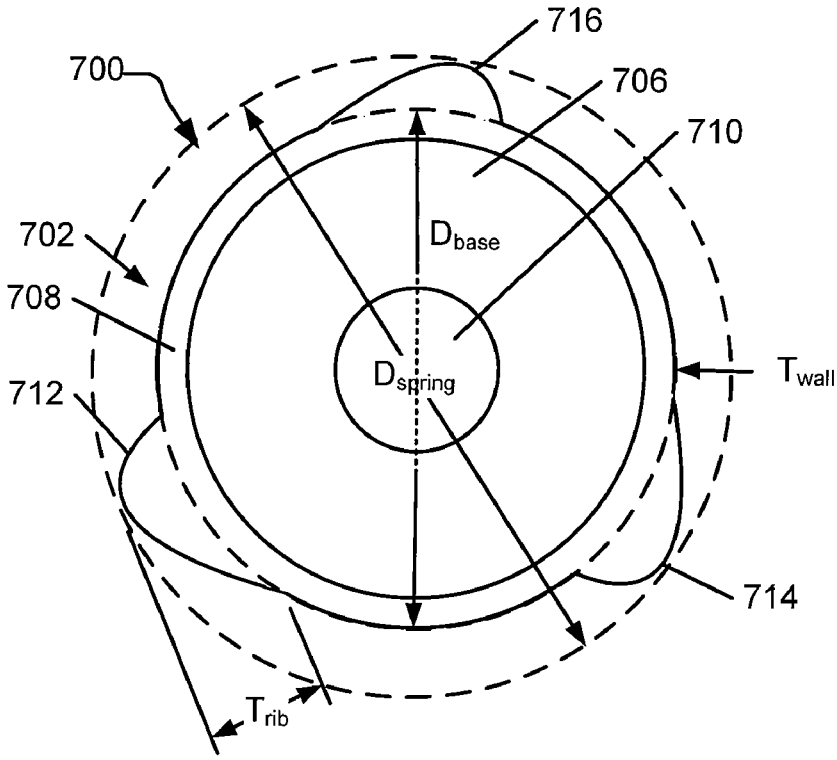

FIGS. 7A and 7B illustrate a first example of a spring device 700 that may be used in fluid-containing bladders and/or other impact-attenuating elements in accordance with examples of this invention. As shown in these figures, the spring device 700 (which may fit into corresponding openings or support structures provided in the fluid-containing bladder) includes a generally cup-shaped body member 702 defined by an exterior non-planar surface 704 and an interior non-planar surface 706. The body member 702 includes a base region 708 and a crown region 710.

The body member 702 may have any desired shape without departing from the invention. For example, it may be parabolic shaped, partially or truncated parabolic shaped, conical shaped, partially or truncated conical shaped, hemi-elliptical shaped (including partially or truncated hemi-elliptical shaped), hemi-oval shaped (including partially or truncated hemi-oval shaped), irregularly shaped, or the like. Moreover, if desired, the exterior surface 704 may be shaped differently from the interior surface 706 (e.g., the exterior surface 704 may be parabolic while the interior surface 706 may be hemispherical, or vice versa). Also, while the illustrated example shows the body member 702 defined by smoothly curving, non-planar surfaces 704 and 706, if desired, in at least some examples, a planar surface, a stepped surface, or any other desired surface configurations may be used without departing from this invention.

In the example spring device 700 illustrated in FIGS. 7A and 7B, the shell or wall thickness (dimension "$T_{wall}$" in FIG. 7B) of the spring device 700 is reduced somewhat from other designs as shown in FIGS. 4 and 6, and the resulting reduction in stiffness is compensated for by adding one or more reinforcing structures for one or more of the surfaces 704 and 706 of the spring device 700. In this illustrated example, the reinforcing structures constitute three raised ribs or flutes 712, 714, and 716 that extend along the exterior surface 704 of the body member 702. Additionally or alternatively, if desired, reinforcing structures, such as raised ribs or flutes or the like, may be provided along interior surface 706 of the body member 702 without departing from this invention.

Many variations in the reinforcing structure(s) are possible without departing from this invention. For example, an individual body member (e.g., 702) may include any number of reinforcing structures (e.g., raised ribs or the like), without departing from the invention, and such structures may be arranged in any desired manner without departing from the invention. For example, an individual body member 702 may have 1-8 raised rib structures, and in some examples 2-5 raised ribs, without departing from the invention. In at least some examples of the invention, when plural reinforcing structures are provided with a body member 702, the reinforcing structures (e.g., the raised ribs) may be evenly spaced around body member 702, e.g., extending from at or near a perimeter of the base region 708 toward the crown region 710. In the example structure illustrated in FIGS. 7A and 7B, the spring device 700 includes three essentially evenly spaced raised ribs 712, 714, and 716.

Raised ribs of the types illustrated in FIGS. 7A and 7B also may have a wide variety of different structures and characteristics without departing from this invention. For example, the thickness of the rib (e.g., the distance from the body member's exterior surface 704 to the rib's most remote location, dimension "$T_{rib}$" in FIG. 7B) may vary widely without departing from the invention (e.g., from 0.5 mm thick or less to 6 mm thick or greater, and in some examples, from 1.5 to 4 mm thick). Additionally, this dimension may remain constant or it may vary over the overall length of an individual rib without departing from the invention. In some example structures, the thickness of an individual rib (e.g., rib 712) will be largest at or proximate to the base region 708 of the spring device 700, and it may gradually reduce its thickness (or taper) to zero thickness at or proximate to the crown region 710. The rib thickness may change in a smooth, constant, tapered manner, in a stepwise manner (in steps the same or different sizes), or in some other manner, e.g., an irregular manner, without departing from the invention. Also, while the rib thickness may decrease over some portion of the rib's length (e.g., moving from the base region 708 toward the crown region 710), the same rib also may increase in thickness over some portion of its length (e.g., moving from the base region 708 toward the crown region 710), without departing from the invention. The rib structures also need not begin directly at the base surface 708 and/or extend all the way to the crown region 710, although they may have either or both of these characteristics without departing from this invention.

While they may do so in at least some examples of the invention, the raised ribs or other reinforcing structures need not extend along the spring body member surface 704 and/or 706 in a straight line or over the shortest route directly from the base region 708 toward the crown region 710. Rather, if desired, in at least some example structures in accordance with this invention, the raised ribs or other reinforcing structures will wrap or extend along the body portion 702 (e.g., along the exterior surface 704 and/or interior surface 706) in an angled or spiraled manner (e.g., Archamede spiraled, angled 0-60° from vertical with respect to the direction directly from the base region 708 to the crown region 710, or the like). In some examples, the spiral or other angling will be about 20-45° from vertical with respect to the direction directly from the base region 708 to the crown region 710.

As illustrated in FIGS. 7A and 7B, the raised ribs 712, 714, and 716 or other reinforcing structures may be integrally formed as a unitary structure with the surface(s) (704 and/or 706) of the body member 702 (e.g., by blow or injection molding, or the like). However, if desired, the raised ribs 712, 714, and 716 or other reinforcing structures may be separately produced and attached to the surface(s) (704 and/or 706) and/or otherwise attached to the body member 702, e.g., by adhesives, cements, fusing techniques, mechanical connectors, friction fits, retaining structures, or the like. Also, while each rib structure (e.g., ribs 712, 714, and 716) and/or other reinforcing element structures may be identical in a given spring device structure 700, this is not a requirement of all examples of the invention. Rather, one or more ribs on a given spring device structure 700 may differ from at least some of the other ribs (e.g., in one or more of the various characteristics described above, such as in its thickness characteristics, its thickness change characteristics over rib length (if any), its rib location characteristics, total rib number, rib angling or spiraling characteristics, etc.). Also, the spring device 700 may have any desired outer diameter (e.g., diameter including the dimensions of the raised ribs (dimension "$D_{spring}$" in FIG. 7B) and/or base diameter ($D_{base}$ in FIG. 7B) departing from this invention.

The spring devices 700 may be made of any suitable or desired materials and/or by any suitable or desired processes without departing from the invention, including from conventional materials and by conventional processes known and used in the footwear art. As some examples, the spring devices 700, including the ribs and other portions of the structure 700, may be made as a single piece construction from thermoplastic materials by molding procedures (e.g., blow or injection molding procedures). As some more specific examples, the spring devices 700 may be made from PEBAX® materials (e.g., thermoplastic, melt-processable, polyether-based polyamides available from various suppliers), including PEBAX® 3533 (available from Atofina Chemicals, Inc.) and/or other thermoplastic or polymeric materials.

Figure 8A:
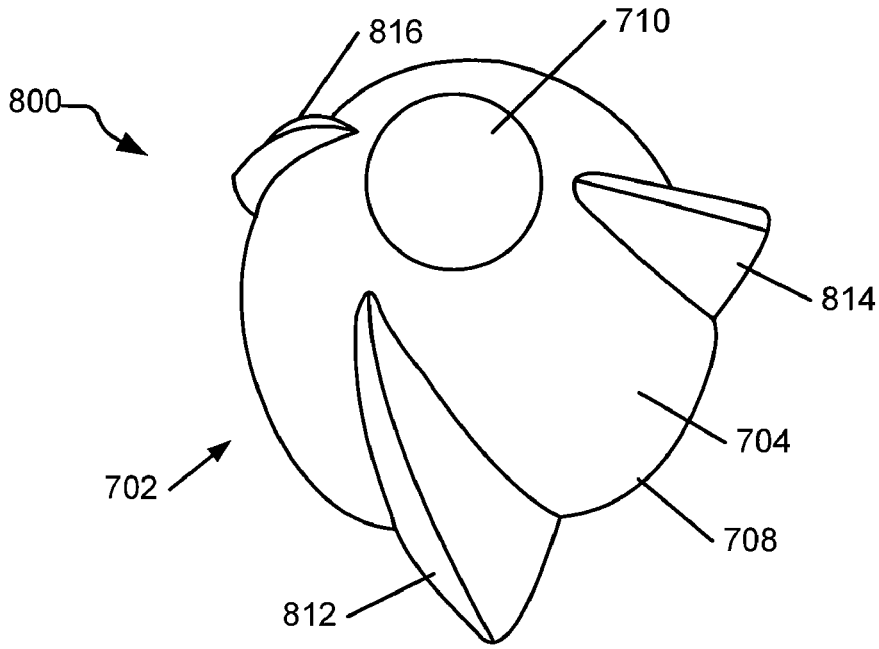
FIGS. 8A and 8B illustrate another example spring device that may be included in impact-attenuating elements in accordance with this invention.
Figure 8B:
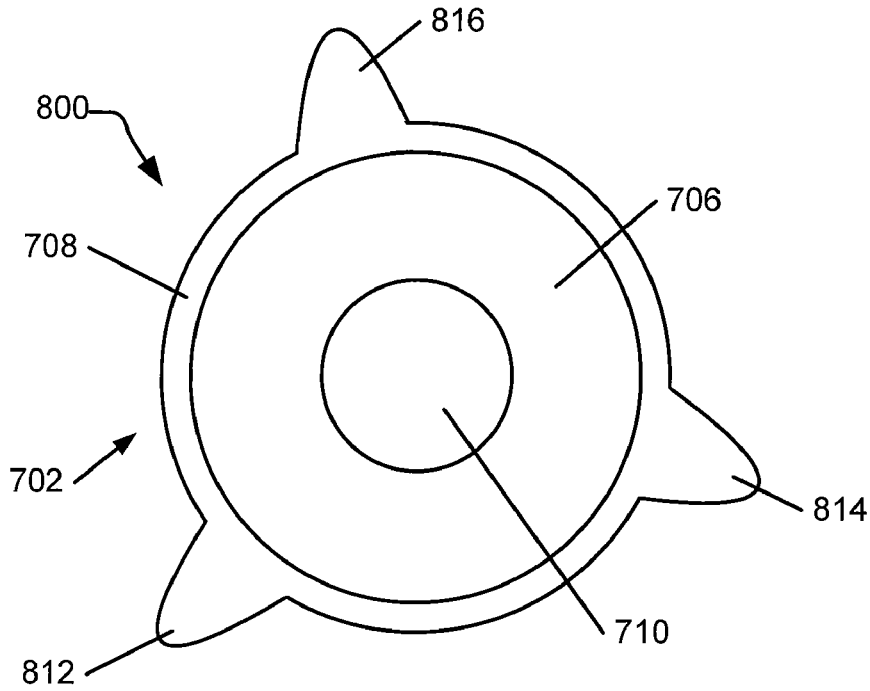

FIGS. 8A and 8B illustrate another example spring device structure 800, including a body member 702 (defined by exterior surface 704 and interior surface 706, each of which may be non-planar or otherwise defining a generally cup-shaped or parabolic body member structure 702). The spring device 800 further includes a base region or area 708 and a crown region or area 710. The main differences between this spring device structure 800 and the structure 700 shown in FIGS. 7A and 7B relate to the reinforcing element structures. Ribs 812, 814, and 816 in FIGS. 8A and 8B are more upright (less angled) and more "triangular" as compared to their counterpart ribs 712, 714, and 716 in the structure 700 shown in FIGS. 7A and 7B. In some examples, the ribs 812, 814, and 816 may be oriented with no angle or spiral with respect to the direction directly from the base region 708 to the crown region 710. Again, however, in this example spring device structure 800, three ribs 812, 814, and 816 are present, and these ribs spiral somewhat and are evenly spaced around the body member 702 of the spring device 800 (e.g., 120 degrees apart, in this example structure). Of course, any number of ribs or other reinforcing structures may be provided, and their specific characteristics may vary widely, as described above, without departing from this invention.

Figure 9A:
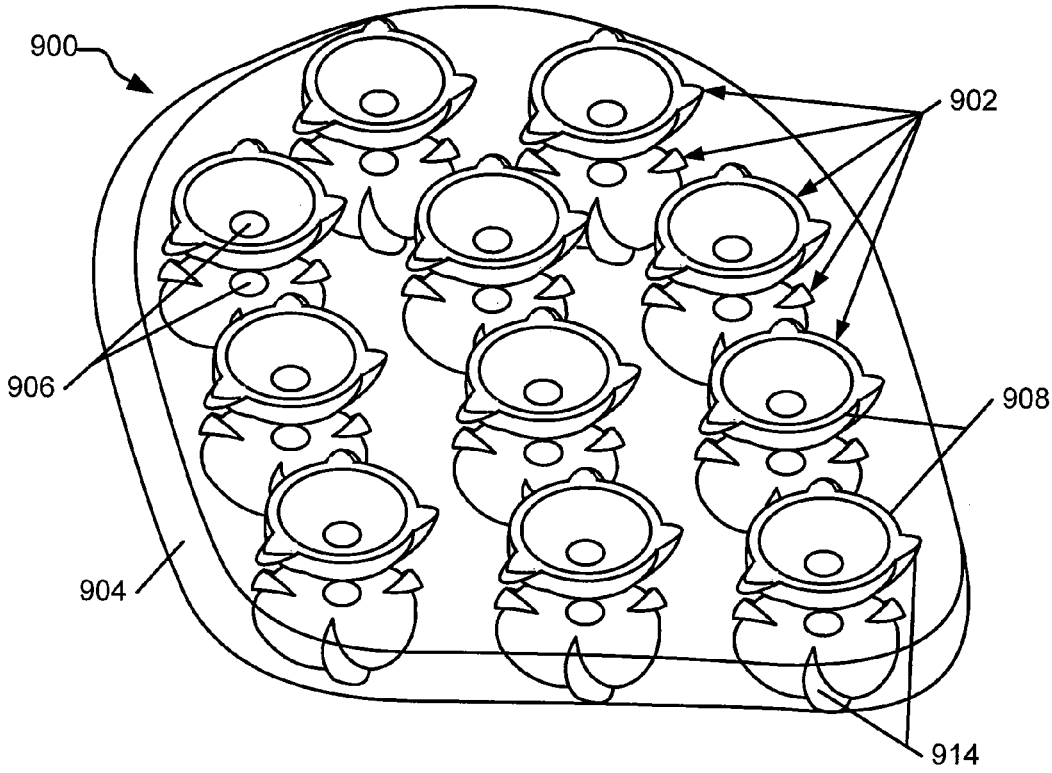
FIGS. 9A and 9B illustrate example impact-attenuating elements including spring devices in accordance with some examples of this invention.

FIG. 9A illustrates an example impact-attenuating element 900 including plural spring devices 902 in accordance with some examples of this invention (e.g., devices 700 or 800). As shown, the impact-attenuating element 900 includes at least one fluid-containing enclosure element 904, e.g., made of plastic or other suitable or desired flexible materials, such as polymeric materials as described above in conjunction with FIGS. 1A through 1E. In this illustrated example, the spring devices 902 are arranged in two levels with the enclosure element 904, one level 910 in the top half of the enclosure element 904 having their crown regions facing the crown regions of a second level 912 of spring devices 902 provided in the bottom half of the enclosure element 904 (see the side view of FIG. 9B). Optionally, if desired, the two levels 910 and 912 may constitute separate fluid-containing enclosure elements or separate chambers (optionally interconnected) in a single fluid-containing enclosure element. Within a given level 910 or 912, spring devices 902 may be arranged at the lateral sides of one another (e.g., in rows and/or columns, staggered, or otherwise arranged), with an exterior surface of one spring device 902 facing an exterior surface of one or more other adjacent spring devices 902. The base regions of each level of spring devices 902 in this example structure 900 face outward, outside of the enclosure element 904. Any suitable or desired spacing between adjacent spring devices 902 (both laterally and/or vertically) may be used without departing from this invention. Additionally, the spacings between adjacent spring devices 902 may vary within a given impact-attenuating element structure 900 without departing from the invention (e.g., there is no requirement for constant spacings between all adjacent spring devices 902 within a given impact-attenuating element 900).

The spring devices 902 may be arranged at least partially within, fixed to, and/or otherwise engaged with the enclosure element 904 in any suitable or desired manner without departing from the invention. For example, adhesives, cements, fusing techniques, mechanical connectors, friction fits, retaining element structures, or the like may be used to arrange and/or fix the spring devices 902 to and/or within an enclosure element 904. As another example, if desired, appropriate surfaces or portions of the enclosure element 904 (such as its exterior surface) may be formed with receptacles (e.g., molded therein by blow or injection molding or the like, e.g., as illustrated in FIGS. 1A-1E and 3A-3C) for receiving the spring devices 902, which may be further fixed thereto, if desired, e.g., by adhesives, cements, fusing techniques, mechanical connectors, friction fits, retaining element structures, or the like. In some examples, structure at the crown region of the spring device 902 (such as the illustrated raised circle area) may engage with corresponding and complementary structure molded into the exterior surface of the impact-attenuating element. These corresponding structures in the enclosure element 904 may be formed in the bottom of openings or depressions formed to receive the overall body of the spring member 902. As another example, spring devices 902 in the top level 910 may be connected with one or more corresponding spring devices 902 in the bottom level 912, and/or spring devices 902 within a given level 910 and 912 may be connected to one another (e.g., by runners as shown in FIG. 6), and these connecting structures may be used, at least in part, to at least partially hold the spring devices 902 in place as an integral unit within the enclosure element 904.

Figure 9B:
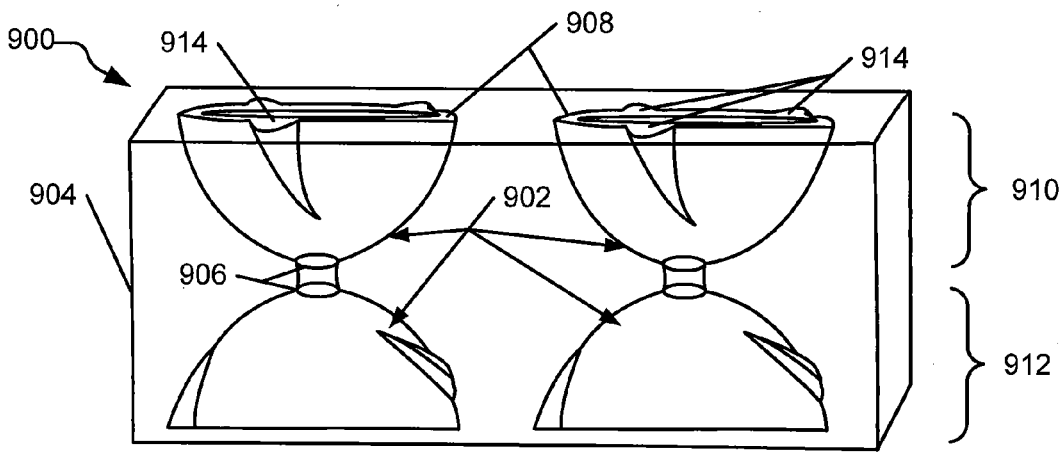

All of the spring devices 902 illustrated in the example structure 900 of FIGS. 9A and 9B are shown as having the same structure (or substantially the same structure) as all other spring devices 902 engaged with the enclosure element 904. While this may be the case in at least some examples according to the invention, it is not a requirement. For example, the specific structures of the spring devices 902 engaged with an enclosure element 904 may vary from one another without departing from the invention. As more specific examples, one or more of the various characteristics described above relating to the spring device structures and/or the reinforcing structures included therewith may vary for a given enclosure element 904 without departing from the invention, e.g., the spring device wall thickness may vary; spring device diameter may vary; rib thickness characteristics may vary; rib thickness change characteristics over rib length (if any) may vary; rib location, structure, or orientation characteristics may vary; rib number may vary; rib angling or spiraling characteristics may vary; etc. As another example, if desired, the spring devices nearer to the perimeter of the enclosure element 904 may differ in structure as compared to the more interior spring device structures. Other variations in spring device structure 902 based on location in the enclosure element 904 are possible without departing from the invention. Also, an enclosure element 904 may contain any desired number of the spring devices 902, having any desired diameters and/or arrangements, without departing from this invention. As an additional optional feature, if desired, runners may be provided between adjacent spring devices 902, both between adjacent spring devices 902 on a given level, e.g., as shown in FIG. 6, and between those on different levels.

FIG. 9B illustrates a partial side view of an example enclosure element 904 showing adjacent spring devices 902. Notably, as described above, the upper level 910 of spring devices 902 and the lower level 912 of spring devices 902 are arranged such that their crown regions or areas 906 and exterior surfaces face each other and such that their base regions or areas 908 face outward, outside of the enclosure element 904. Any suitable or desired distance between spring devices 902 in the upper level 910 and the lower level 912, in an unloaded condition, may be maintained without departing from the invention. Additionally, if desired, the separation distance between spring devices 902 in the upper level 910 and the lower level 912 need not be constant over all areas or regions of the impact-attenuating device structure 900 (e.g., different separations between the levels may be provided at the front of the structure 900 versus the back, etc.). Also, the fluid inflation pressure within the enclosure element 904 (e.g., the gas pressure, if any) may vary widely and be freely selected without departing from this invention. Also, if desired, the enclosure element 904 may be vented to the atmosphere, optionally through a valve member.

If desired, a single fluid-containing chamber may form both the top level 910 and the bottom level 912 of the enclosure element 904, such that the enclosure element 904 is formed as a single piece with the spring devices 902 fit into receptacles formed in opposing surfaces of the enclosure element 904. Alternatively, if desired, the enclosure element 904 may be made from multiple independent pieces, e.g., at least some pieces including one or more spring devices 902 or portions thereof, that are joined together by adhesives, cements, fusing techniques, mechanical connectors, friction fits, retaining elements, or in some other suitable manner. As another example, if desired, the bottom level 912 of enclosure element 904 may be constructed as one piece and one fluid-containing chamber and the top level 910 of enclosure element 904 may be constructed as a separate piece and a separate fluid-containing chamber. Then, the piece making up the top level 910 and the piece making up the bottom level 912 may be joined together (e.g., via adhesives, cements, mechanical connectors, fusing techniques, retaining elements, or the like) to form a complete enclosure element 904 (which will have at least two separate and independent fluid-containing chambers). Of course, each level 910 and/or 912 may be made from multiple pieces, and thus have multiple fluid-containing chambers, without departing from the invention.

Additional structural features that may be controlled and/or varied in accordance with at least some examples of this invention include the relative arrangement of the ribs (or other reinforcing structures) 914 on spring devices 902 in the upper level 910 with respect to those in the lower level 912. For example, the support members and/or spring devices 902 in the upper level 910 need not "mirror" the corresponding adjacent structures in the lower level 912 (although they may do so, if desired). As shown in FIG. 9B, in this example structure, the ribs 914 in the upper level 910 are arranged in a staggered or rotated orientation with respect to the ribs 914 in the lower level 912 (e.g., turned 60° with respect to one another in this example structure). Of course, any amount of rotational separation between the ribs 914 in the upper and lower levels 910 and 912, respectively, including no rotational separation, may be used without departing from the invention. Additionally, there is no need for constant, uniform spacing between the ribs on the different levels in all examples of this invention.

Moreover, as shown in the example structure 900 illustrated in FIG. 9B, the ribs 914 may be angled or spiraled with respect to the direction extending directly from the base regions 908 to the crown regions 906. In at least some example structures according to this invention, the ribs 914 in the top level 910 will be arranged such that they are spiraled or angled in the same direction as the ribs 914 provided in the bottom level 912. FIG. 9B illustrates this common direction of spiraling or angling. In this manner, during substantial compression of the overall impact-attenuating element 900 (e.g., when attenuating ground reaction forces during a step or jump landing, etc.), the ribs 914 on one level will more smoothly fit between and will not interfere with or contact ribs 914 on the other level. This may help increase the overall maximum available compressibility of the impact-attenuating element 900. Of course, if desired, the ribs 914 on one level may spiral or angle in the opposite direction from those on the other level, without departing from this invention.

Figure 10:
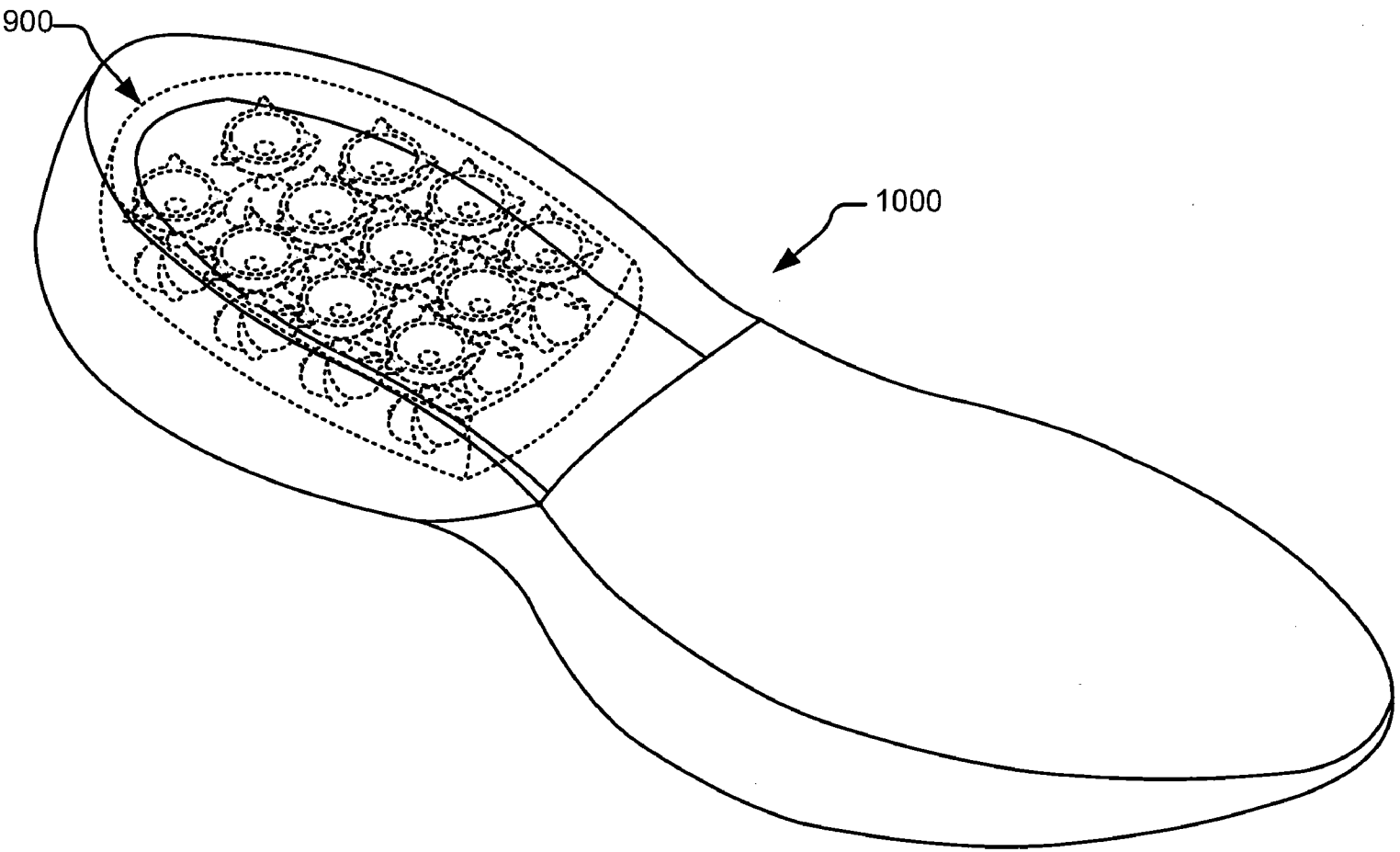
FIGS. 10 and 11 illustrate example arrangements and/or orientations of impact-attenuating elements in a midsole member and/or in an article of footwear or other foot-receiving device, respectively.

As noted above, impact-attenuating elements in accordance with examples of this invention, like element 900 described above, may be included as at least part of a sole member for an article of footwear or other foot-receiving device product. FIG. 10 illustrates an example midsole structure 1000 in which an impact-attenuating element 900 is mounted in the heel portion. The impact-attenuating element 900 may be incorporated in the midsole structure 1000 in any suitable or desired manner without departing from the invention, including in conventional manners known and used in the art. As a more specific example, a polymeric foam material making up the base midsole structure 1000 may be formed to include an open area into which the impact-attenuating element 900 fits. The impact-attenuating element 900 may be held in the midsole structure 1000 in any manner, such as by enclosing the open region receiving the impact-attenuating element 900 with additional midsole structure or material, by enclosing the open region receiving the impact-attenuating element 900 with the outsole or insole structure, by adhesives, cements, fusing techniques, mechanical connections, retaining element structures, friction fits, gravity, or the like.

Figure 11:
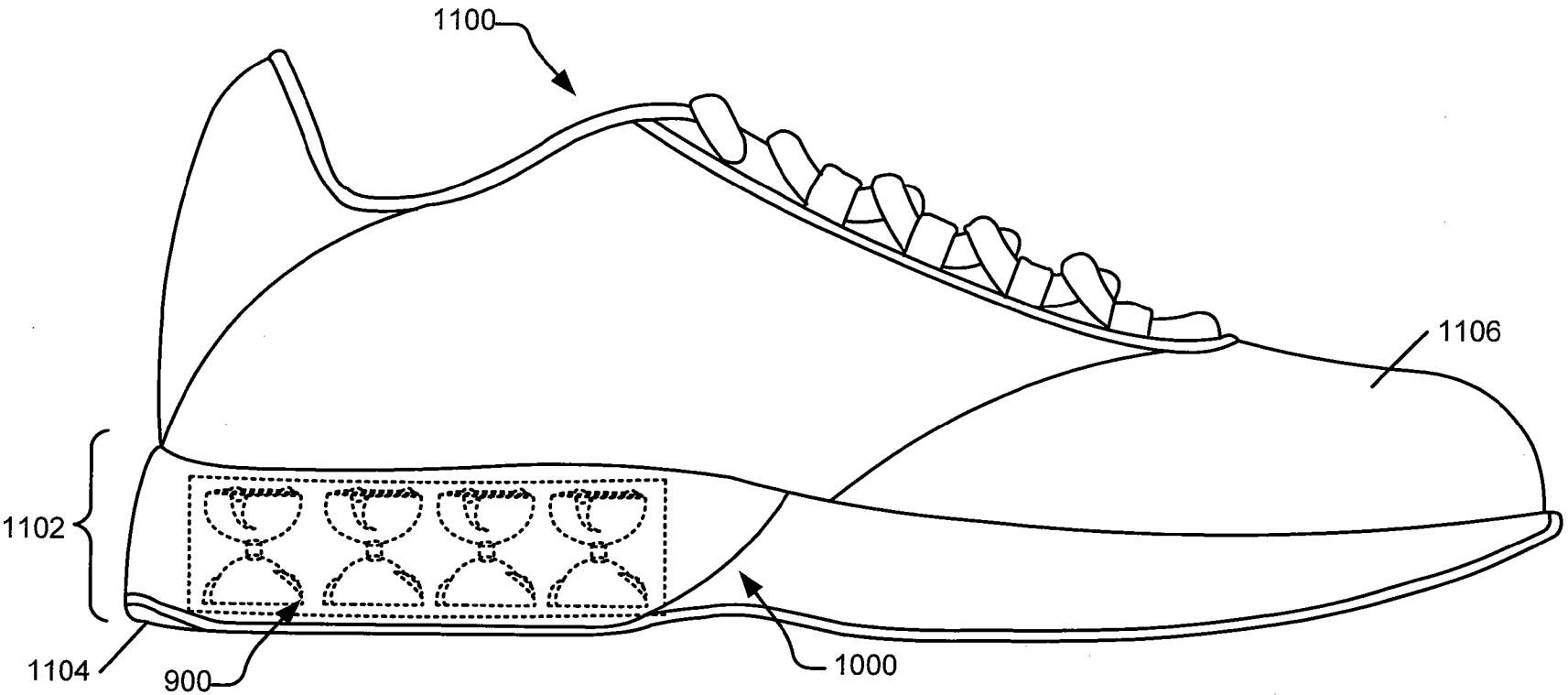

The midsole structure 1000 may be incorporated into an article of footwear or other foot-receiving device product 1100, as shown in FIG. 11, such as in a piece of athletic footwear, sandal, or the like. As shown in FIG. 11, the midsole member 1000 forms a part of the overall sole member 1102 of the footwear product 1100. The sole member 1102 or the article of footwear 1100 in general may include, in addition to midsole member 1000, an outsole portion 1104 and an insole portion, sock liner, and/or bootie member (not shown), which contacts the user's foot. The sole member 1102 may be connected with an upper member 1106 and the overall article of footwear 1100 may be constructed in any suitable or desired manners, including in conventional manners known and used in the art, such as via stitching, adhesives, cements, mechanical connectors, friction fits, fusing techniques, retaining elements, or the like. Of course, either or both of the sole member 1102 and the upper member 1106 may be made from multiple pieces without departing from the invention.

As generally described above, in spring device designs in accordance with at least some examples of this invention, the wall thickness of the spring device ($T_{wall}$) may be reduced as compared to designs of the types shown in FIGS. 4-6, and the resulting reduction in stiffness of the spring device may be compensated for by adding one or more reinforcing structures, e.g., raised ribs, to a surface of the spring device, such as its exterior surface.

Conventional basketball shoes typically require a heel spring device wall thickness in a BLO-5100 airsole of at least 3 mm to achieve the desired stiffness, particularly in the larger sized shoes. A conventional 3 mm thick spring device wall requires almost half of the airsole height in which it is to be inserted to be occupied by solid polymer. This feature greatly reduces the maximum available displacement, which consequently reduces the amount of energy (e.g., contact surface impact forces) the conventional airsole can manage. Additionally, thicker spring devices tend to display exaggerated stiffness during the initial stages of compression, followed by large stiffness reductions in later stages of compression prior to bottoming out.

Impact-attenuating elements in accordance with at least some examples of this invention, including the raised reinforcing rib structures, particularly those with a flute-to-wall thickness ratio of about 2, provided increased maximum available displacement and more constant stiffness throughout compression. In some instances, the impact-attenuating elements provided spring devices with increased maximum displacement, lower initial stiffness values, and more constant stiffness throughout the test range, as compared to conventional airsoles.

When incorporated into an article of footwear, the impact-attenuating element (e.g., element 900) (or at least some portions thereof) may be encapsulated within a polymer foam material, such as polyurethane or ethylvinylacetate making up at least a portion of a midsole of the footwear article. Accordingly, the impact-attenuating element (e.g., element 900) may replace a conventional fluid-containing bladder within a conventional sole structure of an article of footwear. If desired, portions of the impact-attenuating element may be exposed through apertures in the foam material and/or through other portions of the sole member so as to be visible from an exterior of the footwear. Alternatively, if desired, the impact-attenuating element may be entirely encapsulated or enclosed by the foam material and/or other materials making up the midsole and/or other portions of the sole member. An individual impact-attenuating element (e.g., such as element 900) also may have more than one chamber, optionally containing different fluids and/or fluids at different pressures. Of course, any type of fluid may be included in the fluid-containing chamber (if any) of an enclosure element without departing from the invention, including air or other gases or liquids, including gases or other fluids known and used in the art.

D. Conclusion

The preceding discussion disclosed various embodiments of a sole component in accordance with this invention. In general, the sole component includes a fluid-containing bladder and support structures, optionally with spring devices, including reinforcing structures extending around the support structures and/or spring devices. The reinforcing structures may be integrally formed with the support structures and/or spring device bodies, and the spring devices, when present, may be bonded to the exterior of the bladder at the support structure and/or at least partially recessed into the bladder at the support structure. In some examples, the reinforcing structure will extend along the interior and/or exterior surfaces of the support structures and/or spring devices.

The present invention is disclosed above and in the accompanying drawings with reference to various different example embodiments. The purpose served by the disclosure, however, is to provide examples of the various features and concepts related to the invention, and not to limit the scope of the invention. One skilled in the relevant art will recognize that numerous variations and modifications may be made to the example structures described above without departing from the scope of the present invention, as defined by the appended claims.

We claim:

1. An impact-attenuating device, comprising:

a base member including a gas-filled, fluid-tight chamber or a foam material defining a first major surface and a second major surface opposite the first major surface; and a first spring device engaged with the base member and extending into the first major surface toward the second major surface, wherein the first spring device includes a first body member defining a non-planar first surface, and wherein the first spring device further includes a first reinforcing structure including a first raised rib extending along the first surface of the first body member and extending into the base member beyond the first surface of the first body member.

2. An impact-attenuating device according to claim 1, wherein the first raised rib extends along the first surface of the first body member in an angled manner with respect to a direction from a base region to a crown region of the first body member.

3. An impact-attenuating device according to claim 2, wherein a thickness of the first raised rib decreases in the direction from the base region to the crown region.

4. An impact-attenuating device according to claim 1, wherein the first raised rib extends along the first surface of the first body member in a spiral manner.

5. An impact-attenuating device according to claim 4, wherein a thickness of the first raised rib decreases in a direction from a base region to a crown region of the first body member.

6. An impact-attenuating device according to claim 1, wherein the first reinforcing structure further includes a second raised rib extending along the first surface of the first body member.

7. An impact-attenuating device according to claim 6, wherein the first raised rib extends along the first surface of the first body member in an angled manner with respect to a direction from a base region of the first body member to a crown region of the first body member, wherein the second raised rib extends along the first surface of the first body member in an angled manner with respect to the direction from the base region to the crown region, and wherein the second raised rib extends into the base member beyond the first surface of the first body member.

8. An impact-attenuating device according to claim 6, wherein the first raised rib extends along the first surface of the first body member in a spiral manner, wherein the second raised rib extends along the first surface of the first body member in a spiral manner, and wherein the second raised rib extends into the base member beyond the first surface of the first body member.

9. An impact-attenuating device according to claim 1, wherein the first spring device includes a second reinforcing structure provided for the first surface.

10. An impact-attenuating device according to claim 1, further comprising:

a second spring device engaged with the base member, wherein the second spring device includes a second body member defining a non-planar first surface and a first reinforcing structure including a first raised rib extending along the first surface of the second body member.

11. An impact-attenuating device according to claim 10, wherein the first body member includes a first base region and a first crown region, wherein the second body member includes a second base region and a second crown region, and wherein the first base region lies on a common plane or substantially a common plane with the second base region.

12. An impact-attenuating device according to claim 1, wherein the base member includes at least one gas-filled, fluid-tight chamber.

13. An impact-attenuating device, comprising:

a base member including a gas-filled, fluid-tight chamber or foam material defining a first major surface and a second major surface opposite the first major surface;

a first cup-shaped spring device engaged with the base member and extending into the base member, wherein a convex surface of the first cup-shaped spring device includes a first reinforcing structure including a first raised rib extending along the convex surface of the first cup-shaped spring device and extending into the base member beyond the convex surface of the first cup-shaped spring device; and a second cup-shaped spring device engaged with the base member and extending into the base member, wherein a convex surface of the second cup-shaped spring device includes a second reinforcing structure including a second raised rib extending along the convex surface of the second cup-shaped spring device and extending into the base member beyond the convex surface of the second cup-shaped spring device, and wherein the convex surface of the first cup-shaped spring device faces the convex surface of the second cup-shaped spring device.

14. An impact-attenuating device according to claim 13, wherein the base member includes at least one gas-filled, fluid-tight chamber.

15. An article of footwear, comprising:

an upper member; and a sole member engaged with the upper member, wherein the sole member includes an impact-attenuating element including: (a) a base member including a gas-filled, fluid-tight chamber or a foam material defining a first major surface and a second major surface opposite the first major surface, and (b) a first spring device engaged with the base member and extending into the first major surface toward the second major surface, wherein the first spring device includes a first body member defining a non-planar first surface, and wherein the first spring device further includes a first reinforcing structure including a first raised rib extending along the first surface of the first body member and extending into the base member beyond the first surface of the first body member.

16. An article of footwear according to claim 15, wherein the first raised rib extends along the first surface of the first body member in an angled manner with respect to a direction from a base region to a crown region of the first body member.

17. An article of footwear according to claim 15, wherein the first raised rib extends along the first surface of the first body member in a spiral manner.

18. An article of footwear according to claim 15, further comprising:

a second spring device engaged with the base member of the impact-attenuating element, wherein the second spring device includes a second body member defining a non-planar first surface and a first reinforcing structure including a first raised rib extending along the first surface of the second body member.

19. An article of footwear according to claim 15, wherein the impact-attenuating element is provided as at least a portion of a midsole of the sole member.

20. An article of footwear according to claim 15, wherein the base member includes at least one gas-filled, fluid-tight chamber.

21. An article of footwear, comprising:

an upper member; and a sole member engaged with the upper member, wherein the sole member includes an impact-attenuating element including: (a) a base member including a gas-filled, fluid-tight chamber or a foam material defining a first major surface and a second major surface opposite the first major surface, (b) a first cup-shaped spring device engaged with the base member and extending into the base member, wherein a convex surface of the first cup-shaped spring device includes a first reinforcing structure including a first raised rib extending along the convex surface of the first cup-shaped spring device and extending into the base member beyond the convex surface of the first cup-shaped spring device, and (c) a second cup-shaped spring device engaged with the base member and extending into the base member, wherein a convex surface of the second cup-shaped spring device includes a second reinforcing structure including a second raised rib extending along the convex surface of the second cup-shaped spring device and extending into the base member beyond the convex surface of the second cup-shaped spring device, and wherein the convex surface of the first cup-shaped spring device faces the convex surface of the second cup-shaped spring device.

22. An article of footwear according to claim 21, wherein the impact-attenuating element is provided as at least a portion of the midsole of the sole member.

23. An article of footwear according to claim 21, wherein the base member includes at least one gas-filled, fluid-tight chamber.

24. A foot-receiving device, comprising:

a foot-covering member; and a foot-supporting member engaged with the foot-covering member, wherein the foot- supporting member includes an impact-attenuating element including: (a) a base member including a gas-filled, fluid-tight chamber or a foam material defining a first major surface and a second major surface opposite the first major surface, and (b) a first spring device engaged with the base member and extending into the first major surface toward the second major surface, wherein the first spring device includes a first body member defining a non-planar first surface, and wherein the first spring device further includes a first reinforcing structure including a first raised rib extending along the first surface of the first body member and extending into the base member beyond the first surface of the first body member.

25. A foot-receiving device according to claim 24, further comprising:

a second spring device engaged with the base member of the impact-attenuating element, wherein the second spring device includes a second body member defining a non-planar first surface and a first reinforcing structure including a first raised rib extending along the first surface of the second body member.

26. A foot-receiving device according to claim 24, wherein the base member includes at least one gas-filled, fluid-tight chamber.

27. A foot-receiving device, comprising:

a foot-covering member; and a foot-supporting member engaged with the foot-covering member, wherein the foot-supporting member includes an impact-attenuating element including: (a) a base member including a gas-filled, fluid-tight chamber or a foam material defining a first major surface and a second major surface opposite the first major surface, (b) a first cup-shaped spring device engaged with the base member and extending into the base member, wherein a convex surface of the first cup-shaped spring device includes a first reinforcing structure including a first raised rib extending along the convex surface of the first cup-shaped spring device and extending into the base member beyond the convex surface of the first cup-shaped spring device, and (c) a second cup-shaped spring device engaged with the base member and extending into the base member, wherein a convex surface of the second cup-shaped spring device includes a second reinforcing structure including a second raised rib extending along the convex surface of the second cup-shaped spring device and extending into the base member beyond the convex surface of the second cup-shaped spring device, and wherein the convex surface of the first cup-shaped spring device faces the convex surface of the second cup-shaped spring device.

28. A foot-receiving device according to claim 27, wherein the base member includes at least one gas-filled, fluid-tight chamber.

* * * * *